US011986047B2

(12) United States Patent
Whiteman et al.

(10) Patent No.: US 11,986,047 B2
(45) **Date of Patent: *May 21, 2024**

(54) SOLE FOR A SHOE

(71) Applicant: adidas AG, Herzogenaurach (DE)

(72) Inventors: John Whiteman, Nuremburg (DE); Paul Leonard Michael Smith, Nuremburg (DE); Angus Wardlaw, Nuremberg (DE); Heiko Schlarb, Herzogenaurach (DE); James Tarrier, Nuremburg (DE)

(73) Assignee: adidas AG, Herzogenaurach (DE)

( * ) Notice: Subject to any disclaimer, the term of this patent is extended or adjusted under 35 U.S.C. 154(b) by 0 days.

This patent is subject to a terminal disclaimer.

(21) Appl. No.: 17/881,155

(22) Filed: Aug. 4, 2022

(65) Prior Publication Data

US 2022/0369759 A1 Nov. 24, 2022

Related U.S. Application Data

(63) Continuation of application No. 16/918,014, filed on Jul. 1, 2020, now Pat. No. 11,445,783, which is a (Continued)

(30) Foreign Application Priority Data

Feb. 13, 2013 (DE) ..... 102013202353.7
Jan. 28, 2014 (EP) ..... 14152908

(51) Int. Cl.
*A43B 13/12* (2006.01)
*A43B 13/14* (2006.01)
*A43B 13/18* (2006.01)

(52) U.S. Cl.
CPC ..... *A43B 13/125* (2013.01); *A43B 13/14* (2013.01); *A43B 13/181* (2013.01); (Continued)

(58) Field of Classification Search
CPC ..... A43B 13/125; A43B 13/14; A43B 13/181; A43B 13/186; A43B 13/187; A43B 13/188; A43B 13/20; A43B 13/203; A43B 13/206
See application file for complete search history.

(56) References Cited

U.S. PATENT DOCUMENTS

D64,898 S 6/1924 Gunlock
2,131,756 A 10/1938 Roberts
(Continued)

FOREIGN PATENT DOCUMENTS

CN 1034662 8/1989
CN 1036128 10/1989
(Continued)

OTHER PUBLICATIONS

US D748,382 S, 02/2016, Galway et al. (withdrawn)
(Continued)

*Primary Examiner* — Ted Kavanaugh
(74) *Attorney, Agent, or Firm* — Kilpatrick Townsend & Stockton LLP

(57) ABSTRACT

Improved soles for shoes, in particular for sports shoes, are described. A sole for a shoe, in particular a sports shoe, is provided, said sole having a cushioning element that includes randomly arranged particles of an expanded material and a control element. The control element is free from expanded material and reduces the shearing motions in a first region of the cushioning element compared to shearing motions in a second region of the cushioning element.

20 Claims, 20 Drawing Sheets

Related U.S. Application Data continuation of application No. 15/902,641, filed on Feb. 22, 2018, now Pat. No. 10,721,991, which is a continuation of application No. 14/179,090, filed on Feb. 12, 2014, now Pat. No. 9,930,928.

(52) U.S. Cl.
CPC ..... *A43B 13/186* (2013.01); *A43B 13/187* (2013.01); *A43B 13/188* (2013.01)

(56) References Cited

U.S. PATENT DOCUMENTS 2,968,106 A 1/1961 Joiner et al.
3,186,013 A 6/1965 Glassman et al.
3,586,003 A 6/1971 Baker
3,754,746 A 8/1973 Thiele
3,834,046 A 9/1974 Fowler
3,864,181 A 2/1975 Wolinski et al.
D237,323 S 10/1975 Inohara
4,132,016 A 1/1979 Vaccari
4,237,627 A 12/1980 Turner et al.
4,364,189 A 12/1982 Bates
4,481,727 A 11/1984 Stubblefield et al.
4,524,529 A 6/1985 Schaefer
4,546,559 A 10/1985 Dassler et al.
4,624,062 A 11/1986 Autry et al.
4,642,911 A 2/1987 Talarico et al.
4,658,515 A 4/1987 Oatman
4,667,423 A 5/1987 Autry et al.
4,704,239 A 11/1987 Yoshimura et al.
D296,262 S 6/1988 Brown et al.
4,754,561 A 7/1988 Dufour et al.
4,798,010 A 1/1989 Sugiyama et al.
D302,898 S 8/1989 Greenberg
RE33,066 E * 9/1989 Stubblefield ..... A43B 13/184 36/83
4,864,739 A 9/1989 Maestri et al.
4,922,631 A 5/1990 Anderie et al.
4,970,807 A 11/1990 Anderie
5,025,573 A 6/1991 Giese et al.
D329,731 S 9/1992 Adcock et al.
5,150,490 A 9/1992 Busch et al.
D333,556 S 3/1993 Purdom
D337,650 S 7/1993 Thomas, III et al.
D340,797 S 11/1993 Pallera et al.
5,283,963 A 2/1994 Lerner et al.
5,308,420 A 5/1994 Yang
5,319,866 A 6/1994 Foley et al.
D350,016 S 8/1994 Passke et al.
D350,222 S 9/1994 Hase
D356,438 S 3/1995 Opie et al.
5,528,842 A 6/1996 Ricci et al.
5,549,743 A 8/1996 Pearce
D375,619 S 11/1996 Backus et al.
5,617,650 A 4/1997 Grim
5,619,809 A 4/1997 Sessa
5,692,319 A 12/1997 Parker et al.
5,709,954 A 1/1998 Lyden et al.
D389,991 S 2/1998 Elliott
D390,349 S 2/1998 Murai et al.
5,716,723 A * 2/1998 Van Cleef ..... A43B 1/0036 36/25 R
D393,340 S 4/1998 Doxey
D395,337 S 6/1998 Greene
D408,971 S 3/1999 Birkenstock
D408,618 S 4/1999 Wilborn et al.
D413,010 S 8/1999 Birkenstock
5,932,336 A 8/1999 Petrovic et al.
D414,920 S 10/1999 Cahill
D415,610 S 10/1999 Cahill
D415,876 S 11/1999 Cahill
5,996,252 A 12/1999 Cougar
6,014,821 A 1/2000 Yaw
6,041,521 A 3/2000 Wong et al.
D422,400 S 4/2000 Brady et al.
D423,199 S 4/2000 Cahill
6,108,943 A 8/2000 Hudson et al.
D431,346 S 10/2000 Birkenstock
6,199,302 B1 3/2001 Kayano
6,266,896 B1 * 7/2001 Liu ..... A43B 13/12 36/28
D460,852 S 7/2002 Daudier
6,516,540 B2 2/2003 Seydel et al.
6,543,158 B2 4/2003 Dieckhaus
6,564,476 B1 5/2003 Hernandez
6,702,469 B1 3/2004 Taniguchi et al.
6,708,426 B2 3/2004 Erickson et al.
D490,222 S 5/2004 Burg et al.
D490,230 S 5/2004 Mervar
D492,099 S 6/2004 McClaskie
6,782,640 B2 8/2004 Westin
6,796,056 B2 9/2004 Swigart
D498,901 S 11/2004 Hawker et al.
6,849,667 B2 2/2005 Haseyama et al.
6,874,257 B2 4/2005 Erickson et al.
6,925,734 B1 8/2005 Schaeffer et al.
6,948,263 B2 9/2005 Covatch
6,957,504 B2 10/2005 Morris
6,968,637 B1 11/2005 Johnson et al.
D517,302 S 3/2006 Ardissono
7,073,277 B2 7/2006 Erb et al.
7,143,529 B2 12/2006 Robinson, Jr. et al.
D538,518 S 3/2007 Della Valle
7,243,445 B2 7/2007 Manz et al.
7,254,906 B2 8/2007 Morris et al.
D554,848 S 11/2007 Marston
D560,883 S 2/2008 McClaskie
D561,433 S 2/2008 McClaskie
D561,438 S 2/2008 Belley
D561,986 S 2/2008 Horne et al.
D570,581 S 6/2008 Polegato
D571,085 S 6/2008 McClaskie
D572,462 S 7/2008 Hatfield et al.
7,421,805 B2 9/2008 Geer et al.
D586,090 S 2/2009 Turner et al.
D589,690 S 4/2009 Truelsen
D594,187 S 6/2009 Hickman
D596,384 S 7/2009 Andersen et al.
D601,333 S 10/2009 McClaskie
D606,733 S 12/2009 McClaskie
D607,190 S 1/2010 McClaskie
D611,233 S 3/2010 Della Valle
7,673,397 B2 3/2010 Jarvis
D616,183 S 5/2010 Skaja
D617,540 S 6/2010 McClaskie
D618,891 S 7/2010 McClaskie
7,797,856 B2 9/2010 Andrews et al.
D631,646 S 2/2011 Muller
D633,286 S 3/2011 Skaja
D633,287 S 3/2011 Skaja
D634,918 S 3/2011 Katz et al.
D636,156 S 4/2011 Della Valle
D636,569 S 4/2011 McMillan
D636,571 S 4/2011 Avar
7,941,941 B2 5/2011 Hazenberg et al.
D641,142 S 7/2011 Lindseth et al.
D644,827 S 9/2011 Lee
D645,649 S 9/2011 Mcclaskie
D648,105 S 11/2011 Schlageter et al.
D650,159 S 12/2011 Avar
8,082,684 B2 12/2011 Munns
D655,488 S 3/2012 Blakeslee
D659,364 S 5/2012 Jolicoeur
8,186,081 B2 5/2012 Wilson, III et al.
8,205,357 B2 6/2012 Keating et al.
D680,725 S 4/2013 Avar et al.
D680,726 S 4/2013 Propét
D683,116 S 5/2013 Petrie
8,479,412 B2 7/2013 Peyton et al.
8,490,297 B2 7/2013 Guerra
D693,553 S 11/2013 McClaskie
D695,501 S 12/2013 Yehudah
D698,137 S 1/2014 Carr

(56) References Cited

U.S. PATENT DOCUMENTS

D707,934 S 7/2014 Petrie
D709,680 S 7/2014 Herath
8,834,770 B2 9/2014 Nakano et al.
D721,478 S 1/2015 Avent et al.
9,010,157 B1 4/2015 Podhajny et al.
D739,129 S 9/2015 Del Biondi
D739,131 S 9/2015 Del Biondi
D740,003 S 10/2015 Herath
D740,004 S 10/2015 Hoellmueller et al.
9,167,868 B1 10/2015 Koo et al.
9,167,869 B2 10/2015 Koo et al.
9,212,270 B2 12/2015 Künkel et al.
D758,056 S 6/2016 Galway et al.
9,402,439 B2 8/2016 Cross et al.
9,516,918 B2 12/2016 Meschter et al.
D776,410 S 1/2017 Galway et al.
9,554,620 B2 1/2017 Cross et al.
D783,264 S 4/2017 Hoellmueller et al.
9,610,746 B2 4/2017 Wardlaw et al.
9,781,970 B2 10/2017 Wardlaw et al.
9,781,974 B2 10/2017 Reinhardt
9,788,598 B2 10/2017 Reinhardt
9,788,606 B2 10/2017 Reinhardt et al.
9,795,186 B2 10/2017 Reinhardt et al.
9,820,528 B2 11/2017 Reinhardt et al.
9,849,645 B2 12/2017 Wardlaw et al.
9,930,928 B2 * 4/2018 Whiteman ..... A43B 13/125
9,968,157 B2 5/2018 Wardlaw et al.
10,039,342 B2 8/2018 Reinhardt et al.
D828,686 S 9/2018 Hoellmueller et al.
D828,991 S 9/2018 Herath
D840,136 S 2/2019 Herath et al.
D840,137 S 2/2019 Herath et al.
10,259,183 B2 4/2019 Wardlaw et al.
D851,889 S 6/2019 Dobson et al.
D852,475 S 7/2019 Hoellmueller et al.
D853,691 S 7/2019 Coonrod et al.
D853,699 S 7/2019 Coonrod et al.
D855,297 S 8/2019 Motoki
10,506,846 B2 12/2019 Wardlaw et al.
D873,543 S 1/2020 Coonrod et al.
D875,359 S 2/2020 Dobson et al.
D882,927 S 5/2020 Bruns et al.
D882,928 S 5/2020 Bruns et al.
10,639,861 B2 5/2020 Le et al.
D889,810 S 7/2020 Hoellmueller et al.
D891,051 S 7/2020 Smith et al.
10,716,358 B2 7/2020 Reinhardt et al.
D895,234 S 9/2020 Motoki et al.
10,759,096 B2 9/2020 Smith et al.
D899,061 S 10/2020 Coonrod et al.
D906,648 S 1/2021 Hoellmueller
D915,055 S 4/2021 Herath et al.
D915,749 S 4/2021 Groneck
D916,444 S 4/2021 Callow et al.
D925,179 S 7/2021 Hoellmueller
D927,154 S 8/2021 Coonrod et al.
D928,479 S 8/2021 Le et al.
D932,760 S 10/2021 Thompson
D938,154 S 12/2021 Dobson et al.
D943,880 S 2/2022 Bruns et al.
D943,895 S 2/2022 Coonrod et al.
D955,703 S 6/2022 Tanzini et al.
11,445,783 B2 * 9/2022 Whiteman ..... A43B 13/188
2002/0007568 A1 * 1/2002 Kellerman ..... A43B 7/28 36/35 R
2002/0162247 A1 11/2002 Hokkirigawa et al.
2002/0166262 A1 11/2002 Hernandez
2003/0131501 A1 7/2003 Erickson et al.
2003/0158275 A1 8/2003 McClelland et al.
2003/0172548 A1 9/2003 Fuerst
2003/0208925 A1 11/2003 Pan
2004/0032042 A1 2/2004 Chi
2004/0138318 A1 7/2004 McClelland et al.
2004/0211088 A1 10/2004 Volkart
2005/0065270 A1 3/2005 Knoerr et al.
2005/0081406 A1 4/2005 Hoffer
2005/0108898 A1 5/2005 Jeppesen et al.
2005/0150132 A1 * 7/2005 Iannacone ..... A43B 3/105 36/11.5
2005/0241181 A1 11/2005 Cheng
2005/0268490 A1 12/2005 Foxen
2006/0010717 A1 1/2006 Finkelstein
2006/0021251 A1 2/2006 Swigart et al.
2006/0026863 A1 * 2/2006 Liu ..... A43B 7/08 36/25 R
2006/0042120 A1 3/2006 Sokolowski et al.
2006/0083912 A1 4/2006 Park et al.
2006/0125134 A1 6/2006 Lin et al.
2006/0134351 A1 6/2006 Greene et al.
2006/0156579 A1 7/2006 Hoffer et al.
2006/0218819 A1 10/2006 Wu
2006/0235095 A1 10/2006 Leberfinger et al.
2006/0277792 A1 12/2006 Schoenborn
2006/0283046 A1 12/2006 Mason
2007/0193070 A1 8/2007 Bertagna et al.
2007/0199213 A1 8/2007 Campbell et al.
2007/0220778 A1 9/2007 Fusco et al.
2007/0295451 A1 12/2007 Willis
2008/0047538 A1 2/2008 Gan
2008/0052965 A1 3/2008 Sato et al.
2008/0060221 A1 3/2008 Hottinger et al.
2008/0244932 A1 10/2008 Nau et al.
2008/0250666 A1 10/2008 Votolato
2009/0013558 A1 1/2009 Hazenberg
2009/0025260 A1 1/2009 Nakano
2009/0061146 A1 * 3/2009 Segato ..... B62J 1/00 428/68
2009/0113758 A1 5/2009 Nishiwaki et al.
2009/0119023 A1 5/2009 Zimmer et al.
2009/0145004 A1 6/2009 Jones
2009/0217550 A1 9/2009 Koo et al.
2009/0235557 A1 9/2009 Christensen et al.
2009/0277047 A1 11/2009 Polegato
2009/0293309 A1 12/2009 Keating et al.
2009/0320330 A1 12/2009 Borel et al.
2010/0043255 A1 2/2010 Trevino
2010/0063778 A1 3/2010 Schrock et al.
2010/0122472 A1 5/2010 Wilson, III et al.
2010/0154257 A1 6/2010 Bosomworth et al.
2010/0218397 A1 9/2010 Nishiwaki et al.
2010/0222442 A1 * 9/2010 Prissok ..... C08J 9/232 521/56
2010/0229426 A1 9/2010 Brown
2010/0242309 A1 9/2010 McCann
2010/0287788 A1 11/2010 Spanks et al.
2010/0287795 A1 11/2010 Van Niekerk
2010/0293811 A1 11/2010 Truelsen et al.
2011/0047720 A1 3/2011 Maranan et al.
2011/0067272 A1 3/2011 Lin
2011/0099845 A1 5/2011 Miller
2011/0146110 A1 6/2011 Geer
2011/0232135 A1 9/2011 Dean et al.
2011/0247237 A1 10/2011 Jara et al.
2011/0252668 A1 10/2011 Chen
2011/0283560 A1 11/2011 Portzline et al.
2011/0302805 A1 12/2011 Vito et al.
2012/0005920 A1 1/2012 Alvear et al.
2012/0047770 A1 3/2012 Dean et al.
2012/0059075 A1 3/2012 Prissok et al.
2012/0073160 A1 3/2012 Marvin et al.
2012/0124861 A1 5/2012 Losani
2012/0174432 A1 7/2012 Peyton
2012/0177777 A1 7/2012 Brown et al.
2012/0204449 A1 8/2012 Stockbridge et al.
2012/0233877 A1 9/2012 Swigart et al.
2012/0233883 A1 9/2012 Spencer et al.
2012/0235322 A1 9/2012 Greene et al.
2012/0266490 A1 10/2012 Atwal et al.
2012/0304491 A1 12/2012 Kimura et al.
2013/0019505 A1 1/2013 Borel et al.
2013/0150468 A1 6/2013 Füssi et al.
2013/0255103 A1 10/2013 Dua et al.
2013/0266792 A1 10/2013 Nohara et al.

(56) References Cited

U.S. PATENT DOCUMENTS

| | | | | |
|---|---|---|---|---|
| 2013/0269215 | A1 | 10/2013 | Smirman et al. | |
| 2013/0291409 | A1* | 11/2013 | Reinhardt | A43B 17/006 36/43 |
| 2014/0017450 | A1* | 1/2014 | Baghdadi | B29C 44/445 264/109 |
| 2014/0033573 | A1 | 2/2014 | Wills | |
| 2014/0066530 | A1 | 3/2014 | Shen et al. | |
| 2014/0075778 | A1 | 3/2014 | Bruce et al. | |
| 2014/0075787 | A1 | 3/2014 | Cartagena | |
| 2014/0197253 | A1 | 7/2014 | Lofts et al. | |
| 2014/0223673 | A1 | 8/2014 | Wardlaw et al. | |
| 2014/0223776 | A1 | 8/2014 | Wardlaw et al. | |
| 2014/0223777 | A1 | 8/2014 | Whiteman et al. | |
| 2014/0223783 | A1 | 8/2014 | Wardlaw et al. | |
| 2014/0227505 | A1* | 8/2014 | Schiller | B32B 27/065 521/170 |
| 2014/0325871 | A1 | 11/2014 | Price et al. | |
| 2014/0366403 | A1 | 12/2014 | Reinhardt et al. | |
| 2014/0366404 | A1 | 12/2014 | Reinhardt et al. | |
| 2014/0366405 | A1 | 12/2014 | Reinhardt et al. | |
| 2014/0373392 | A1 | 12/2014 | Cullen | |
| 2015/0082668 | A1 | 3/2015 | Nakaya et al. | |
| 2015/0089841 | A1 | 4/2015 | Smaldone et al. | |
| 2015/0166270 | A1 | 6/2015 | Buscher et al. | |
| 2015/0174808 | A1 | 6/2015 | Rudolph et al. | |
| 2015/0197617 | A1 | 7/2015 | Prissok et al. | |
| 2015/0237823 | A1 | 8/2015 | Schmitt et al. | |
| 2015/0313310 | A1 | 11/2015 | Okamoto et al. | |
| 2015/0344661 | A1 | 12/2015 | Spies et al. | |
| 2015/0351493 | A1 | 12/2015 | Ashcroft et al. | |
| 2016/0037859 | A1 | 2/2016 | Smith | |
| 2016/0044992 | A1 | 2/2016 | Reinhardt | |
| 2016/0046751 | A1 | 2/2016 | Spies et al. | |
| 2016/0121524 | A1 | 5/2016 | Däschlein et al. | |
| 2016/0128426 | A1 | 5/2016 | Reinhardt et al. | |
| 2016/0227876 | A1 | 8/2016 | Le et al. | |
| 2016/0244583 | A1 | 8/2016 | Keppeler | |
| 2016/0244584 | A1 | 8/2016 | Keppeler | |
| 2016/0244587 | A1 | 8/2016 | Gutmann et al. | |
| 2016/0278481 | A1 | 9/2016 | Le et al. | |
| 2016/0295955 | A1 | 10/2016 | Wardlaw et al. | |
| 2016/0302508 | A1 | 10/2016 | Kormann et al. | |
| 2016/0346627 | A1 | 12/2016 | Le et al. | |
| 2017/0259474 | A1 | 9/2017 | Holmes et al. | |
| 2017/0340067 | A1 | 11/2017 | Dyckmans et al. | |
| 2017/0341326 | A1 | 11/2017 | Holmes et al. | |
| 2017/0341327 | A1 | 11/2017 | Le et al. | |
| 2018/0154598 | A1 | 6/2018 | Kurtz et al. | |
| 2018/0206591 | A1 | 7/2018 | Whiteman et al. | |
| 2018/0235310 | A1 | 8/2018 | Wardlaw et al. | |
| 2018/0290349 | A1 | 10/2018 | Kirupanantham et al. | |
| 2018/0303198 | A1 | 10/2018 | Reinhardt et al. | |
| 2019/0021435 | A1 | 1/2019 | Kormann et al. | |
| 2019/0291371 | A1 | 9/2019 | Wardlaw et al. | |
| 2020/0060383 | A1 | 2/2020 | Le et al. | |
| 2020/0113280 | A1 | 4/2020 | Wardlaw et al. | |
| 2020/0221820 | A1 | 7/2020 | Le et al. | |
| 2020/0230905 | A1 | 7/2020 | Le et al. | |
| 2020/0253328 | A1 | 8/2020 | Reinhardt et al. | |
| 2020/0315290 | A1 | 10/2020 | Reinhardt et al. | |
| 2020/0329812 | A1 | 10/2020 | Le et al. | |
| 2020/0391417 | A1 | 12/2020 | Smith | |
| 2021/0016531 | A1 | 1/2021 | Kurtz et al. | |
| 2021/0113893 | A1 | 4/2021 | Le et al. | |
| 2021/0161249 | A1 | 6/2021 | Smith et al. | |
| 2021/0195985 | A1 | 7/2021 | Kormann et al. | |
| 2021/0219655 | A1 | 7/2021 | Duemler et al. | |
| 2021/0362450 | A1 | 11/2021 | Le et al. | |
| 2021/0368907 | A1 | 12/2021 | Wardlaw et al. | |
| 2021/0370561 | A1 | 12/2021 | Holmes et al. | |
| 2021/0370629 | A1 | 12/2021 | Wardlaw et al. | |
| 2022/0079288 | A1 | 3/2022 | Wardlaw et al. | |
| 2022/0143873 | A1 | 5/2022 | Sahanga et al. | |
| 2022/0167708 | A1 | 6/2022 | Reinhardt et al. | |
| 2022/0234256 | A1 | 7/2022 | Siltamäki et al. | |

FOREIGN PATENT DOCUMENTS

| | | | |
|---|---|---|---|
| CN | 2511160 | | 9/2002 |
| CN | 1451332 | | 10/2003 |
| CN | 2722676 | | 9/2005 |
| CN | 2796454 | | 7/2006 |
| CN | 2888936 | | 4/2007 |
| CN | 101003679 | | 7/2007 |
| CN | 101107113 | | 1/2008 |
| CN | 101190049 | | 6/2008 |
| CN | 201223028 | | 4/2009 |
| CN | 101484035 | | 7/2009 |
| CN | 201341504 | Y | 11/2009 |
| CN | 101611950 | | 12/2009 |
| CN | 202233324 | | 5/2012 |
| CN | 202635746 | | 1/2013 |
| CN | 102917612 | A | 2/2013 |
| CN | 102970891 | A | 3/2013 |
| CN | 202907958 | | 5/2013 |
| CN | 203182138 | U | 9/2013 |
| CN | 103371564 | | 10/2013 |
| CN | 203262404 | | 11/2013 |
| CN | 203618871 | U | 6/2014 |
| CN | 203692653 | | 7/2014 |
| CN | 103976506 | | 8/2014 |
| CN | 203828180 | | 9/2014 |
| CN | 104106876 | A | 10/2014 |
| CN | 104320985 | A | 1/2015 |
| CN | 104640468 | A | 5/2015 |
| DE | 3605662 | | 6/1987 |
| DE | 4236081 | | 4/1994 |
| DE | 29718491 | | 2/1998 |
| DE | 19652690 | | 6/1998 |
| DE | 19950121 | | 11/2000 |
| DE | 10010182 | | 9/2001 |
| DE | 10244433 | B4 | 12/2005 |
| DE | 10244435 | B4 | 2/2006 |
| DE | 102004063803 | | 7/2006 |
| DE | 102005050411 | | 4/2007 |
| DE | 202008017042 | | 3/2009 |
| DE | 102008020890 | | 10/2009 |
| DE | 102009004386 | | 7/2010 |
| DE | 202010008893 | | 12/2010 |
| DE | 202010015777 | U1 | 1/2011 |
| DE | 112009001291 | | 4/2011 |
| DE | 102010052783 | | 5/2012 |
| DE | 202012005735 | | 8/2012 |
| DE | 102011108744 | A1 | 1/2013 |
| DE | 102012206094 | | 10/2013 |
| DE | 102013202291 | | 8/2014 |
| DE | 102013202353 | A1 | 8/2014 |
| DE | 102013208170 | | 11/2014 |
| EM | 001286116-0001 | | 7/2011 |
| EM | 001286116-0002 | | 7/2011 |
| EM | 001286116-0003 | | 7/2011 |
| EM | 001286116-0004 | | 7/2011 |
| EM | 001286116-0005 | | 7/2011 |
| EM | 001286116-0006 | | 7/2011 |
| EP | 0165353 | | 12/1985 |
| EP | 752216 | | 1/1997 |
| EP | 0873061 | | 10/1998 |
| EP | 0958752 | A1 | 11/1999 |
| EP | 1197159 | | 4/2002 |
| EP | 1424105 | | 6/2004 |
| EP | 1854620 | | 11/2007 |
| EP | 1872924 | | 1/2008 |
| EP | 2110037 | A1 | 10/2009 |
| EP | 2233021 | | 9/2010 |
| EP | 2250917 | | 11/2010 |
| EP | 2316293 | | 5/2011 |
| EP | 2342986 | | 7/2011 |
| EP | 2446768 | | 5/2012 |
| EP | 2204102 | B1 | 8/2013 |
| EP | 2649896 | | 10/2013 |
| EP | 2540184 | B1 | 7/2014 |
| EP | 2792261 | A1 | 10/2014 |
| EP | 2848144 | | 3/2015 |
| EP | 2939558 | | 11/2015 |
| EP | 3067100 | | 9/2016 |

(56) References Cited

FOREIGN PATENT DOCUMENTS

| | | | |
|---|---|---|---|
| ES | 1073997 | | 6/2011 |
| FR | 2683432 | | 5/1993 |
| GB | 2258801 | | 2/1993 |
| GB | 2425242 | A | 10/2006 |
| JP | S57-501062 | A | 6/1982 |
| JP | S63-159501 | | 10/1988 |
| JP | 01274705 | | 11/1989 |
| JP | H03-170102 | A | 7/1991 |
| JP | 2913603 | | 6/1999 |
| JP | 2000197503 | | 7/2000 |
| JP | 2002-238609 | | 8/2002 |
| JP | 2002-325602 | | 11/2002 |
| JP | 2002361749 | | 12/2002 |
| JP | 2005218543 | | 8/2005 |
| JP | 2008-509734 | A | 4/2008 |
| JP | 2008073548 | | 4/2008 |
| JP | 2008-532618 | | 8/2008 |
| JP | 2009-142705 | | 7/2009 |
| JP | 2009-527326 | | 7/2009 |
| JP | 2009-535157 | | 10/2009 |
| JP | 2010-017364 | A | 1/2010 |
| JP | 2011-177403 | | 9/2011 |
| JP | 2011-234901 | A | 11/2011 |
| JP | 2012-528661 | A | 11/2012 |
| JP | 2012-249744 | | 12/2012 |
| JP | 6247107 | B2 | 11/2017 |
| JP | 6679363 | B2 | 3/2020 |
| KR | 1020110049293 | | 5/2011 |
| TW | 201012407 | | 4/2010 |
| WO | 8906501 | | 7/1989 |
| WO | 1994020568 | A1 | 9/1994 |
| WO | 2001/001806 | A1 | 1/2001 |
| WO | 2002/008322 | | 1/2002 |
| WO | 2005023920 | | 3/2005 |
| WO | 2005026243 | A1 | 3/2005 |
| WO | 2005066250 | | 7/2005 |
| WO | 2006015440 | | 2/2006 |
| WO | 2006027671 | | 3/2006 |
| WO | 2006/034807 | A1 | 4/2006 |
| WO | 2006/038357 | | 4/2006 |
| WO | 2006090221 | | 8/2006 |
| WO | 2007082838 | | 7/2007 |
| WO | 2007/100451 | | 9/2007 |
| WO | 2008047538 | A1 | 4/2008 |
| WO | 2008058147 | A2 | 5/2008 |
| WO | 2008087078 | | 7/2008 |
| WO | 2009039555 | | 4/2009 |
| WO | 2009095935 | | 8/2009 |
| WO | 2009146368 | | 12/2009 |
| WO | 2010010010 | | 1/2010 |
| WO | 2010037028 | | 4/2010 |
| WO | 2010045144 | | 4/2010 |
| WO | 2010136398 | | 12/2010 |
| WO | 2011134996 | A1 | 11/2011 |
| WO | 2012065926 | | 5/2012 |
| WO | 2013013784 | | 1/2013 |
| WO | 2013168256 | | 11/2013 |
| WO | 2014046940 | | 3/2014 |
| WO | 2014/119774 | A1 | 8/2014 |
| WO | 2015052265 | A1 | 4/2015 |
| WO | 2015052267 | A1 | 4/2015 |
| WO | 2015075546 | A1 | 5/2015 |

OTHER PUBLICATIONS

Extended European Search Report, European Patent Application No. 20206640.3, dated Feb. 12, 2021, 7 pages.
Office Action, German Patent Application No. 102013202353.7, dated Jan. 20, 2014, 17 pages.
Office Action, European Patent Application No. 14152908.1, dated Apr. 13, 2017, 5 pages.
U.S. Appl. No. 14/179,090 , Final Office Action, dated Oct. 12, 2016, 11 pages.
U.S. Appl. No. 14/179,090 , Final Office Action, dated Jun. 22, 2017, 19 pages.
U.S. Appl. No. 14/179,090 , Non-Final Office Action, dated May 11, 2016, 11 pages.
U.S. Appl. No. 14/179,090 , Non-Final Office Action, dated Feb. 1, 2017, 24 pages.
U.S. Appl. No. 14/179,090 , Notice of Allowance, dated Nov. 7, 2017, 6 pages.
U.S. Appl. No. 14/179,090 , Notice of Allowance, dated Jan. 12, 2018, 7 pages.
U.S. Appl. No. 15/902,641 , Non-Final Office Action, dated Dec. 2, 2019, 22 pages.
U.S. Appl. No. 15/902,641, Notice of Allowance, dated Mar. 25, 2020, 9 pages.
Office Action, German Patent Application No. 10 2013 202 353.7, dated Aug. 16, 2017, 13 pages.
European Patent Application No. 14152903.2, European Search Report, dated Sep. 5, 2014 (8 pages).
European Patent Application No. 14152908.1, European Search Report dated Feb. 6, 2015, 6 pages.
Baur et al., "Saechtling Kunststoff Taschenbuch", Hanser Verlag, 31. Ausgabe, Oct. 2013, 18 pages (9 pages for the original document and 9 pages for the English translation).
Gunzenhausen et al., "The right turn (part 1)—Determination of Characteristic values for assembly injection molding", Journal of Plastics Technology, Apr. 2008, pp. 1-8 (English translation of Abstracted provided).
Chinese Patent Application No. 201410049713.7, Office Action dated Aug. 25, 2015, 8 pages (No English translation available. A summary of the Office Action is provided in the Transmittal Letter submitted herewith).
Venable LLP, Letter, dated Jan. 14, 2016, 6 pages.
European Application No. 14152908.1, Office Action dated Mar. 4, 2016, 4 pages.
Office Action, Japanese Patent Application No. 2014-025324 , 7 pages.
"https://www.britannica.com/print/article/463684", Aug. 17, 2016, 15 pgs.
Office Action, Chinese Patent Application No. 201410049713.7, dated Oct. 19, 2016, 7 pages.
Nauta, "Stabilisation of Low Density, Closed Cell Polyethylene Foam", University of Twente, Netherlands, 2000, 148 pages.
"Colour and Additive Preparations for Extruded Polyolefin Foams", Gabriel-Chemie Group, 20 pages,available at www.gabriel-chemie.com/downloads/folder/PE%20foams_en.pdf, last accessed on Jan. 17, 2017.
http://www.dow.com/polyethylene/na/en/fab/foaming.htm, 1 page, Dec. 7, 2011.
Third Party Submission, U.S. Appl. No. 14/981,168, Nov. 14, 2016, 44 pages.
Office Action, Japanese Patent Application No. 2014-025324, dated Jan. 17, 2017, 4 pages.
Office Action, Japanese Patent Application No. 2014-025324, dated Jun. 6, 2017, 1 page (English translation).
Office Action , German Patent Application No. 10 2013 202 353.7, dated Aug. 16, 2017.
U.S. Appl. No. 62/137,139, filed Mar. 23, 2015, Unpublished.
European Extended Search Report, European Patent Application No. 18181579.6, dated Mar. 8, 2019, 6 pages.
Office Action, Chinese Patent Application No. 201710436814.3, dated May 27, 2019, 17 pages.
Office Action, Japanese Patent Application No. 2017-122951, dated May 22, 2018, 5 pages.
Office Action, German Patent Application No. 102013202353.7, dated Aug. 16, 2019, 8 pages.
*U.S. Appl. No. 16/918,014, Restriction Requirement, dated Dec. 10, 2021, 5 pages.
*U.S. Appl. No. 16/918,014, Non-Final Office Action, dated Feb. 1, 2022, 23 pages.
*U.S. Appl. No. 16/918,014, Notice of Allowance, dated May 16, 2022, 8 pages.
*U.S. Appl. No. 17/854,272, filed Jun. 30, 2022, Unpublished.
U.S. Appl. No. 17/653,373, filed Mar. 3, 2022, Unpublished.

(56) References Cited

OTHER PUBLICATIONS

U.S. Appl. No. 29/814,198, filed Nov. 4, 2021, Unpublished.
U.S. Appl. No. 29/813,809, filed Nov. 1, 2021, Unpublished.
U.S. Appl. No. 29/777,634, filed Apr. 7, 2021, Unpublished.
U.S. Appl. No. 29/800,246, filed Jul. 20, 2021, Unpublished.
U.S. Appl. No. 29/773,594, filed Mar. 20, 2021, Unpublished.
U.S. Appl. No. 29/838,720, filed May 15, 2022, Unpublished.
U.S. Appl. No. 29/767,743, filed Jan. 25, 2021, Unpublished.
U.S. Appl. No. 29/822,795, filed Jan. 12, 2022, Unpublished.
Decision of Rejection, Japanese Patent Application No. 2021-179939, dated May 30, 2023, 11 pages.
Office Action, European Patent Application No. 20206640.3, dated Jun. 13, 2023, 4 pages.
Office Action, Japanese Patent Application No. 2021-179939, dated Jan. 10, 2023, 6 pages.

* cited by examiner

SOLE FOR A SHOE

CROSS REFERENCE TO RELATED APPLICATION

This application is a continuation of U.S. application Ser. No. 16/918,014, filed on Jul. 1, 2020 entitled SOLE FOR A SHOE ("the '014 application"), which is a continuation of U.S. application Ser. No. 15/902,641, filed on Feb. 22, 2018 entitled SOLE FOR A SHOE ("the '641 application"), which is a continuation application of U.S. application Ser. No. 14/179,090, filed on Feb. 12, 2014 entitled SOLE FOR A SHOE ("the '090 application"), which is related to and claims priority benefits from German Patent Application No. DE 10 2013 202 353.7, filed on Feb. 13, 2013, entitled SOLE FOR A SHOE ("the '353 application"), and from European Patent Application No. EP 14 152 908.1, filed on Jan. 28, 2014, entitled SOLE FOR A SHOE ("the '908 application"). The '614, '641, '090, '353 and '908 applications are hereby incorporated herein in their entireties by this reference.

FIELD OF THE INVENTION

The present invention relates to a sole for a shoe, in particular a sports shoe.

BACKGROUND

By means of soles, shoes are provided with a plethora of properties which can be pronounced in various strengths, depending on the specific type of shoe. Primarily, shoe soles typically have a protective function. They protect the foot of the respective wearer, due to their increased stiffness compared to the shoe shaft, against injuries caused by, e.g., sharp objects on which the wearer may tread. Furthermore, the shoe sole, due to an increased abrasion resistance, usually protects the shoe against excessive wear. In addition, shoe soles can improve the grip of the shoe on the respective ground and thus enable faster movements. A further function of a shoe sole can consist in its providing certain stability. Furthermore, a shoe sole can have a cushioning effect, for example, by absorbing the forces occurring during contact of the shoe with the ground. Finally, a shoe sole can protect the foot from dirt and spray water or provide a plurality of other functionalities.

In order to satisfy this plethora of functionalities, different materials are known from the prior art from which shoe soles can be manufactured. Exemplarily, shoe soles made from ethylene-vinyl-acetate (EVA), thermoplastic polyurethane (TPU), rubber, polypropylene (PP) or polystyrene (PS) are mentioned here. Each of these various materials provides a special combination of different properties which are more or less well-suited for the specific requirements of the respective shoe type. TPU, for example, is very abrasion-resistant and tear-proof. Furthermore, EVA distinguishes itself by a high stability and a relatively good cushioning effect. In addition, the use of expanded materials, in particular of expanded thermoplastic urethane (eTPU), was taken into consideration for the manufacture of a shoe sole. Thus, for example, WO 2005/066250 A1 describes methods for the manufacture of shoes whose shoe shaft is adhesively connected to a sole on the basis of foamed thermoplastic urethane. Expanded thermoplastic urethane distinguishes itself by a low weight and particularly good elasticity and cushioning properties.

In addition to cushioning and absorbing the shock energy produced when the foot treads on the ground, i.e. a cushioning in vertical direction, it is further known form prior art that during running, also shear forces occur in horizontal direction, in particular on grounds where a shoe has a good grip and the shoe is hence stopped abruptly together with the foot when contacting the ground. In case these shear forces cannot be absorbed at least partially by the ground and/or the sole of the shoe, the shear forces are transmitted with undiminished effect to the movement apparatus, in particular the knee. This easily leads to an excessive burdening of the movement apparatus and promotes injuries. On the other hand, excessive shear capacity of the shoe sole would mean a loss of stability, in particular during faster running, which would lead to an increased risk of injuries. The increased shear capacity can also be undesired in specific regions of the sole, since these regions precisely serve to stabilize the foot. Furthermore, an increased shear capacity, e.g. in the area of the toes or of the midfoot, can give the wearer a sensation of slipping of the shoe during running, which can reduce the wear comfort.

In order to solve this problem, sole constructions are known from the prior art, e.g. from DE 102 44 433 B4 and DE 102 44 435 B4, which can absorb in a way that does not strain the joints a part of the shear forces occurring during running. However, a disadvantage of these constructions consists in the fact that such soles are composed of several independent individual parts, have a fairly high weight and are expensive and complex in manufacture.

Moreover, US 2005/0150132 A1 discloses footwear (e.g., shoes, sandals, boots, etc.) that is constructed with small beads stuffed into the footbed, so that the beads can shift about due to pressure on the footbed by the user's foot during normal use. U.S. Pat. No. 7,673,397 B2 discloses an article of footwear with support assembly having a plate and indentations formed therein. U.S. Pat. No. 8,082,684 B2 discloses a sole unit for a shoe having at least one decoupling track between regions of sole unit allowing for the decoupling of the regions in response to forces from foot-ground contact. DE 10 2011 108 744 A1 discloses a method for the manufacture of a sole or part of a sole for a shoe. WO 2007/082838 A1 discloses foams based on thermoplastic polyurethanes. US 2011/0047720 A1 discloses a method of manufacturing a sole assembly for an article of footwear. Finally, WO 2006/015440 A1 discloses a method of forming a composite material.

Starting from the prior art, it is therefore an objective of the present invention to provide better soles for shoes, in particular for sports shoes. A further objective is to provide improved possibilities by means of which the shear capacity of shoe soles can be selectively influenced in specific regions of the sole.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments of the present invention, a sole for a shoe, in particular a sports shoe, comprises a cushioning element which comprises randomly arranged particles of an expanded material. The sole further comprises a control element free from expanded material, wherein the control element reduces shearing motions in a first region of the cushioning element compared to shearing motions in a second region of the cushioning element.

The use of a cushioning element comprising expanded material may be advantageous for the construction of a shoe sole, since this material is very light, but is able, at the same time, to absorb the shock energy when the foot treads on the ground and to restore that energy to the runner. This increases the running efficiency and reduces the (vertical) impact burden upon the movement apparatus. A further advantage is provided by the use of randomly arranged particles of the expanded material. These particles considerably facilitate the manufacture of such a sole, since the particles are particularly easy to handle and, due to their random arrangement, no orientation is necessary during manufacture.

The use of a control element allowing for selectively controlling the shear capacity of the cushioning element further allows for constructing soles that can also absorb and/or cushion horizontal shear forces which otherwise would have a direct impact on the movement apparatus, in particular the joints. This further increases the wear comfort of the shoe and the efficiency of the runner, while simultaneously preventing injuries and joint wear. Since this control element is preferably free from expanded material, it has sufficient strength for complying with its control function.

In some embodiments, the particles of expanded material comprise one or more of the following materials: expanded ethylene-vinyl-acetate (eEVA), expanded thermoplastic urethane (eTPU), expanded polypropylene (ePP), expanded polyamide (ePA), expanded polyether block amide (ePEBA), expanded polyoxymethylene (ePOM), expanded polystyrene (PS), expanded polyethylene (ePE), expanded polyoxyethylene (ePOE), and expanded ethylene propylene diene monomer (eEPDM). According to the sole profile requirements, one or more of these materials may be used for the manufacture of the sole due to their substance-specific properties.

In other embodiments, the control element comprises one or more of the following materials: rubber, non-expanded thermoplastic urethane, textile materials, PEBA, foils, and foil-like materials.

In additional embodiments, the first region of the cushioning element comprises a higher intrinsic shear resistance than the second region of the cushioning element. The use of such a cushioning element with regions of different intrinsic shear resistance in combination with a control element, which locally influences the shear capacity of the cushioning element, offers freedom and various adaption possibilities in the construction of a shoe sole.

In some embodiments, the control element has a larger thickness and/or fewer holes in a first control region controlling the shearing motion of the cushioning element in the first region than in a second control region controlling the shearing motion of the cushioning element in the second region. Based on the thickness and the number and size of the holes, etc., the bending and deformation resistance of the control element can be determined, for example. These properties of the control element can, for their part, influence the shear and the bending capacity of the different regions of the cushioning element.

In certain embodiments, the cushioning element is provided as a component of a midsole. In further embodiments, the control element is provided as a part of an outsole.

By means of the construction of the cushioning element as a part of a midsole and/or of the control element as a part of an outsole, the number of different functional components of the sole and the shoe may be minimized and, at the same time, the adaption and control possibilities of the sole properties may be increased. This simplifies, e.g., the construction of the shoe and can reduce its weight considerably. Furthermore, additional composite materials such as adhesives for bonding the different elements of the sole and the shoe are not required. Consequently, the manufacture of the shoe is eventually more cost-effective together with improved functionality and furthermore offers improved recycling possibilities, since materials of common material classes may be used.

In further embodiments, the outsole comprises a decoupling region that is not directly attached to the second region of the cushioning element of the midsole. As explained in detail further below, this feature enables further influence and/or increase in the shear capacity of the sole. So, for example, a control element provided as a part of an outsole may be bonded by a gel or the like to a cushioning element provided as a part of a midsole. The gel allows a further shearing effect between the control element and the cushioning element and thus allows absorbing higher shear forces.

According to further embodiments of the invention, the control element and the cushioning element may be manufactured from materials of a common material class, in particular from thermoplastic urethane. This allows a simplified manufacture of the sole and the shoe. In particular, materials from a common material class can often be bonded with each other and processed together in a significantly easier way than materials from different classes.

According to additional embodiments of the invention, the first region is located in the medial region of the midfoot and the second region in the lateral region of the heel. The shear forces occurring during running are especially produced when the foot contacts the ground. This happens typically with the lateral region of the heel. For this reason, a good shear capacity of the sole for absorbing the shear forces is desirable there. In the medial region of the foot, however, a supporting effect and increased stability are often desired. This allows a better pushing the foot off the ground and can furthermore prevent a pronation of the foot, which can lead to irritations and injuries.

In some embodiments, the control element further increases the bending resistance of the cushioning element in the first region compared to the second region. In particular, a control element designed as a part of an outsole may provide this functionality.

According to additional embodiments of the invention, the sole comprises a frame made from non-expanded material, in particular from ethylene-vinyl-acetate, which surrounds at least a part of the cushioning element. Such a frame enables, for example, a further control of the shear capacity and may also be used to increase the stability of the sole.

In certain embodiments, the cushioning element allows for a shearing motion in longitudinal direction of a lower sole surface relative to an upper sole surface of more than 1 mm. This value offer a good balance between a sufficient stability of the shoe sole and a high absorption capacity for horizontal shear forces.

The control element may be laser-cut from a blank. For example, the control element can be provided in form as an outsole, or part of an outsole, which is laser-cut from a blank.

In the simplest form, the blank may be provided as a material layer comprising, for example, one or more of the materials suitable for the manufacture of a control element/outsole mentioned above. It is also possible, for example, that the blanks are provided in different sizes, thickness, with predefined holes, bulges, etc. and they may also comprise the general outline of a foot or sole.

Laser-cutting the control element may provide for a large freedom in design for the control element. It can also provide for the opportunity of an individual customization of the control element, sole and shoe. It may, for example, allow for numerous fashion designs and individualization of each sole or shoe. The customization may be sport specific, according to typical movements of a customer, or otherwise customer-related. Furthermore, the laser-cutting may be automated to a large degree and may be based on, e.g., online tools or other ordering methods.

The above mentioned customization features and online ordering may, however, also be used in connection with other embodiments of inventive soles and shoes described herein or otherwise conceivable, without the control element necessarily being laser-cut from a blank.

Additional embodiments the present invention relate to a shoe, in particular a sports shoe, with a sole according to one or more of the preceding embodiments of the invention. Here, individual features of the mentioned embodiments of the invention may be combined with one another, depending on the profile requirements for the sole and the shoe. Furthermore, it is possible to leave single features aside, if these features should be irrelevant for the respective purpose of the shoe.

BRIEF DESCRIPTION OF THE DRAWINGS

In the following detailed description, embodiments of the invention are described referring to the following figures:

FIG. 13*e*).

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

In the following detailed description, embodiments of the invention relating to sports shoes are described. It is, however, emphasized that the present invention is not limited to these embodiments. The present invention can, for example, also be used for safety shoes, casual shoes, trekking shoes, golf shoes, winter shoes or other shoes as well as for protective clothing and paddings in sports apparel and sports equipment.

Figure 1:
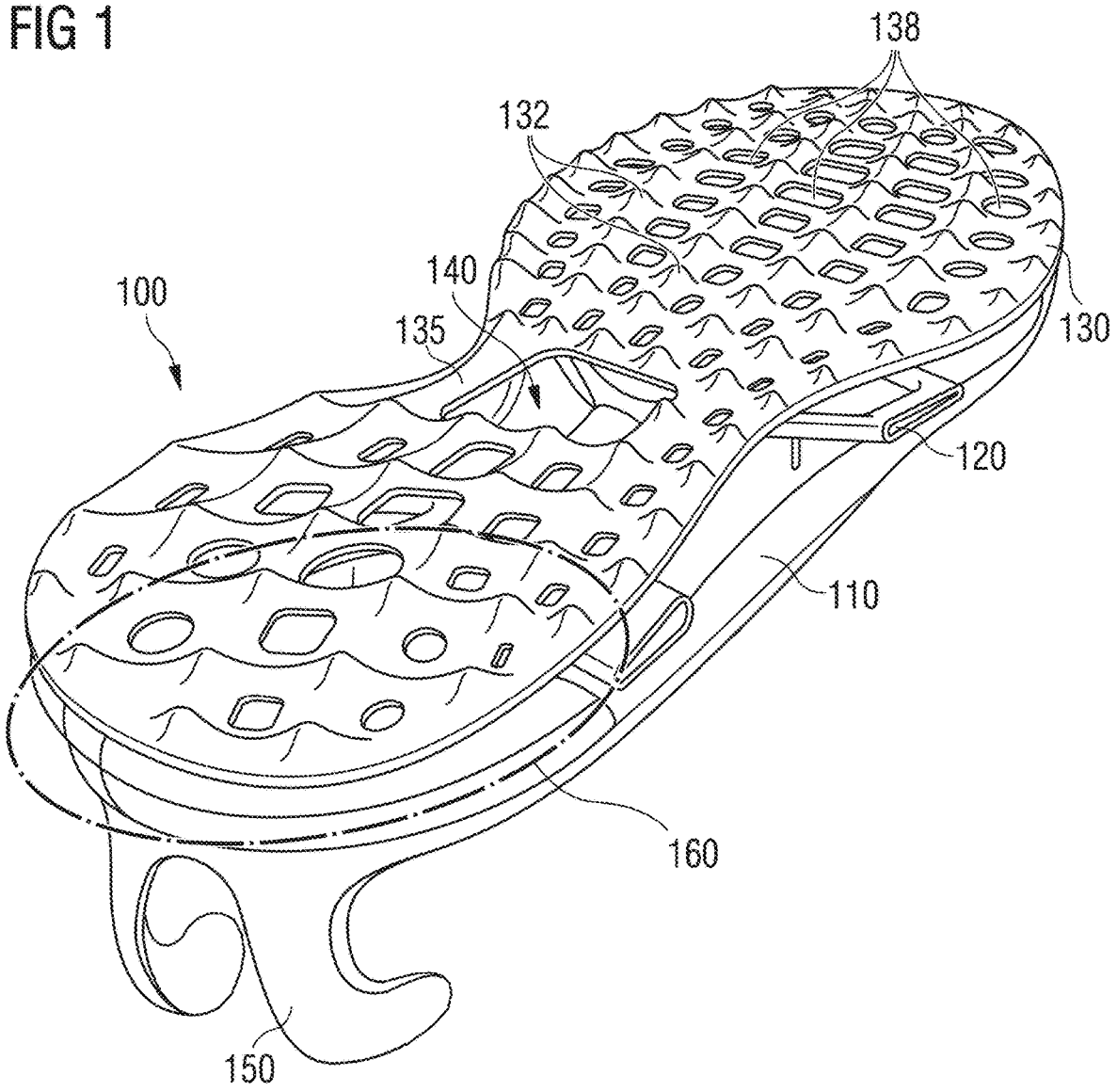
FIG. 1 is a perspective view of a shoe sole with a midsole and an outsole that selectively influences the shear capacity and the bending capacity of the midsole, wherein the sole further comprises a reinforcing element partially embedded in the midsole, as well as a heel clip, according to certain embodiments of the present invention.

FIG. 1 shows a sole 100 according to certain embodiments of the present invention. The sole 100 comprises a cushioning element 110 which comprises randomly arranged particles of an expanded material, as well as a control element 130 which selectively influences the shear capacity of the cushioning element.

In certain embodiments, the cushioning element 110 is provided, as shown in FIG. 1, as a midsole or a part of the midsole, respectively. The cushioning element 110 comprises randomly arranged particles of an expanded material. In some embodiments, the whole cushioning element 110 comprises expanded material. Here, however, different expanded materials, or mixtures of several different expanded materials, may be used in various partial regions of the cushioning element 110. In further embodiments, only one or more partial regions of the cushioning element 110 comprise expanded material, while the rest of the cushioning element 110 comprises non-expanded material. For example, a cushioning element 110 may comprise a central region of particles of one or more expanded materials, said central region being surrounded by a frame of non-expanded material in order to increase the form stability of the sole. By means of an appropriate combination of expanded and/or non-expanded materials, a cushioning element 110 with the desired cushioning and stability properties may be manufactured.

The particles of the expanded material may, in particular, comprise one or more of the following materials: expanded ethylene-vinyl-acetate (eEVA), expanded thermoplastic urethane (eTPU), expanded polypropylene (ePP), expanded polyamide (ePA), expanded polyether block amide (ePEBA), expanded polyoxymethylene (ePOM), expanded polystyrene (PS), expanded polyethylene (ePE), expanded polyoxyethylene (ePOE), and expanded ethylene propylene diene monomer (eEPDM). Each of these materials has specific characteristic properties which, depending on the requirement profile for the sole, may be advantageously used for the manufacture of the shoe sole. In particular, eTPU has excellent cushioning properties which remain unchanged also at lower or higher temperatures. Furthermore, eTPU is very elastic and restores the energy stored during compression, e.g. when treading on the ground, almost entirely to the foot during subsequent expansion. On the other hand, EVA, for example, distinguishes itself by great strength and is therefore suitable, e.g., for the construction of a frame which surrounds regions of expanded material or the whole cushioning element 110, so as to give the cushioning element 110 high form stability.

The use of various materials or mixtures of different materials for the manufacture of the cushioning element 110 further allows for providing cushioning elements 110 comprising regions with different intrinsic shear resistances. In connection with a control element 130, as described herein, this significantly increases the freedom of design in the construction of shoe soles 100 and thereby the possibilities of selectively influencing the shear behavior of the shoe sole 100.

In certain embodiments, the control element 130, as shown in FIG. 1, is provided as an outsole or as a part of an outsole. The control element 130 here may comprise one or more of the following materials: rubber, non-expanded thermoplastic urethane, textile materials, PEBA, as well as foils or foil-like materials. In certain embodiments, the cushioning element 110 and the control element 130 are manufactured from materials of a common material class, in particular expanded and/or non-expanded thermoplastic urethane. This significantly simplifies the manufacturing process, as, for example, the cushioning element 110 and the control element 130 may be provided as one integral piece in a single mold without additional use of adhesives.

In order to selectively influence the shear behavior of the cushioning element 110, the control element has a number of protrusions 132 which are different in size, hardness and expansion, elevations or bulges 135 of different lengths, thicknesses and structures, as well as openings and recesses 138 with different diameters. By varying these design possibilities, the influence exerted by the control element 130 on the shear behavior of the cushioning element 110 may be selectively controlled.

Figure 16A:
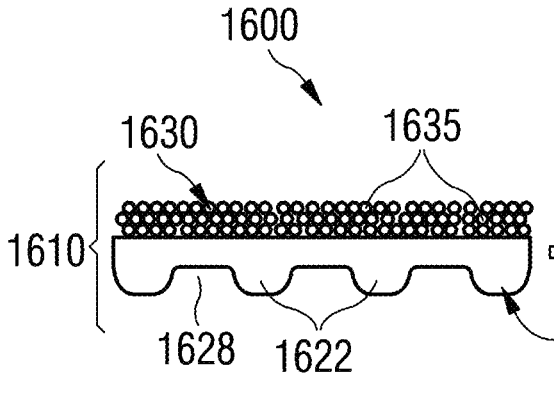
FIGS. 16*a*-*b* are side views of a shoe sole with a midsole and an outsole which selectively influences the shear capacity and the bending capacity of the midsole, according to certain embodiments of the present invention.
Figure 16B:
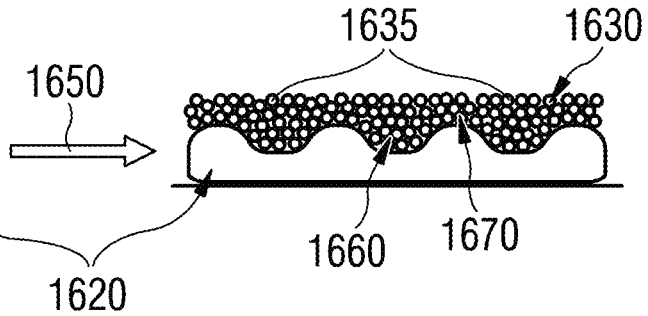

FIGS. 16*a-b*, for example, show certain embodiments 1600 of a sole 1610 according to the invention for a shoe which comprises a cushioning element 1630 provided as a midsole and which comprises randomly arranged particles 1635 of an expanded material. FIG. 16*a* shows the unloaded state and FIG. 16*b* shows the loaded state after touching 1650 the ground. The sole 1610 further comprises a control element 1620 provided as an outsole and which comprises a number of protrusions 1622 as well as a number of recesses/depressions 1628. Here, the material of the control element 1620 may have a higher strength/stiffness than the material of the midsole 1630. For example, the control element 1620 may be provided as a foil onto which the protrusions 1622 may be selectively applied. For example, the control element 1620 may be a foil from TPU onto which protrusions 1622 also made from TPU may be applied. Such embodiments have the advantage that the foil and the protrusions, for example, can enter into a chemical bond without using additional bonding agents and which is extremely stable and resistant. In other embodiments, the control element comprises other/additional materials.

As shown in FIG. 16*b*, after touching 1650 the ground, the protrusions 1622 press into the material of the midsole 1630, since the material of the control element 1620, as already mentioned, may be of a higher stiffness/strength than the material of the midsole 1630. Thereby, regions 1660 and 1670 are formed in which the material of the midsole 1630 is compressed to varying degrees.

In particular, the material of the midsole in the regions 1670, in which the protrusions 1622 press under load into the midsole 1630, is compressed to a higher degree than in the regions 1660, in which the control element comprises recesses/depressions 1628. The different compressions of the midsole material caused thereby selectively influence the stretching and/or shear capacity of the midsole material in the corresponding regions 1660 and 1670. For example, the stretching capacity of the midsole material decreases in the further compressed regions 1670 as compared to the less compressed regions 1660. Furthermore, this leads to an anchoring of the midsole 1630 at the outsole 1620 and hence to an increased ground grip.

Thus, the stretching and/or shear capacity of the midsole 1630 may be selectively activated or suppressed in individual partial regions by means of different designs of the control element 1620 with varied protrusions 1622.

The protrusions 1622 may be of varied design. For example, the protrusions 1622 may have any suitable shape or configuration including but not limited to pointed, cone-shaped, pyramid-shaped, cylindrical, and hemispherical. The control element 1620 likewise may have any suitable shape including but not limited to wave-like and so forth. The protrusions 1622 here serve as a kind of anchor points which allow for a targeted local compression of the midsole material. Widely spaced protrusions 1622 here allow, for example, for greater stretching movements of the midsole materials than closer spaced protrusions 1622. The shear capacity of the midsole 1630 may also be selectively influenced thereby.

Figure 17:
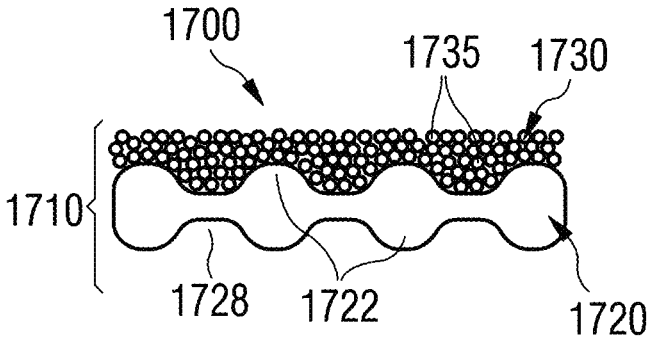
FIG. 17 is a side view of a shoe sole with a midsole and an outsole which selectively influences the shear capacity and the bending capacity of the midsole, according to certain embodiments of the present invention.

FIG. 17 shows certain embodiments 1700 of a sole 1710 according to the invention that comprises a cushioning element 1730 provided as a midsole and which comprises randomly arranged particles 1735 of an expanded material, in unloaded state. The sole 1710 further comprises a control element 1720 provided as an outsole, said control element comprising a number of protrusions 1722 and a number of recesses/depressions 1728. The material of the control element 1720 here may have a higher strength/stiffness than the material of the midsole 1730. The symmetrical, wave-like design of the control element shown in FIG. 17 may provide a particularly good anchoring of the midsole 1730 to the control element 1720 under load, as described above, and thus a particularly good ground grip. Furthermore, the control element 1720 may be designed in such a way that it may be introduced without any problem into a mold used for manufacture, during the manufacturing process.

Figure 18:
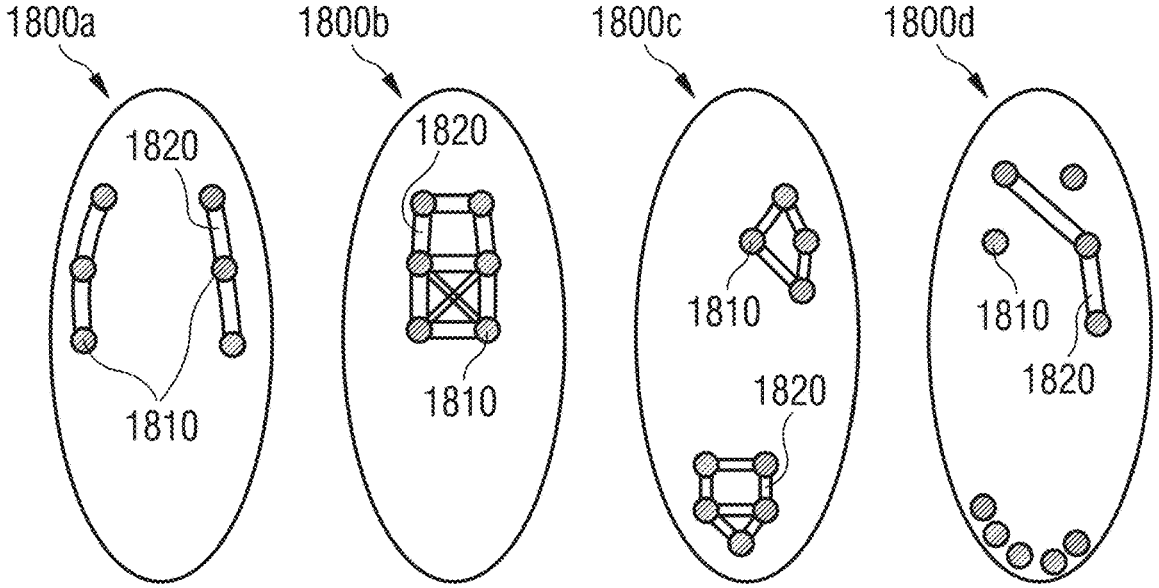
FIG. 18 is a schematic representation of possible embodiments for outsoles which selectively influence the shear and bending capacity of a midsole.

FIG. 18 schematically shows further embodiments of control elements 1800*a*, 1800*b*, 1800*c* and 1800*d* according to the invention. The embodiments 1800*a*, 1800*b*, 1800*c* and 1800*d*, may be provided as an outsole or parts thereof, comprise a number of protrusions 1810, as well as depressions and/or reinforcing elevations 1820, which can, for example, connect two protrusions to each other. Here, the protrusions 1810 may comprise a number of different shapes, sizes, heights, etc., as already discussed above. The same applies to the depressions and/or reinforcing elevations 1820. For example, their width/thickness and/or depth/height as well as their position and orientation on the control elements 1800*a*, 1800*b*, 1800*c* and 1800*d* may be adapted to the sole according to the respective requirements in order to selectively influence the properties of the sole. Here, too, it is explicitly emphasized that the depressions and/or reinforcing elevations 1820 do not necessarily need be arranged between two protrusions 1810, but may serve as stand-alone possibilities to design control elements according to the invention. In particular, such a reinforcing elevation may be advantageously used in the medial midfoot region (cf. 1455) in order to increase the stability of the sole there and to reduce the shear and stretching capacity of the midsole material in this region.

Furthermore, a control element may, according to a further aspect of the invention, comprise additional functional elements, such as, e.g., a torsion- and/or reinforcing element and the like, as a component and be manufactured as one integral piece therewith.

In addition, a control element may be provided as a complete outsole. In further embodiments, however, an outsole comprises a number of individual independent control elements which may also be connected to each other.

In some embodiments, the first region, which has a reduced shear capacity as compared to the second region, is located in the medial region of the midfoot, while the second region is located in the lateral region of the heel. In certain embodiments, the control element 130 comprises in particular a stabilizing bulge 135 at the medial edge of the midfoot region, as well as a number of openings with a diameter increasing towards the heel and the tip of the foot. The shear behavior of the cushioning element 110 adjusted in this way advantageously supports the natural physiological processes in the movement apparatus of a runner and increases the wear comfort and the efficiency of the runner, along with a minimization of the risk of injuries.

Besides influencing the shear behavior of the cushioning element 110, the control element may also influence the bending resistance of the cushioning element. For example, if the control element 130 is firmly attached to the cushioning element 130 in a region, the bending resistance of the control element 130 also influences the bending resistance of the cushioning element 110. The bending resistance of the control element 130, for its part, depends, for example, on the above-mentioned design options of the control element 130. So, in the embodiments shown in FIG. 1, the bending resistance in the heel and toe region is lower than in the midfoot region which is stabilized by means of the reinforcing bulge 135.

In further embodiments, the sole 100 further comprises a decoupling region 160. In this region, the cushioning element 110 and the control element 130 are not directly connected to each other. In some embodiments, there is no connection at all between the cushioning element 110 and the control element 130 in this region. In certain embodiments, the cushioning element 110 and the control element 130 are bonded in this region by means of a material which has a shear capacity. In these embodiments, this material with shear capacity comprises, for example, one or more of the following materials: eTPU, foamed material, or a gel. This enables a further shearing motion of the cushioning element 110 with respect to the control element 130 and thus an additional possibility of influencing the shear behavior of the sole 100. Such a decoupling region 160 may be located in the lateral heel region, since here, as will be shown further below in greater detail, the strongest shear forces occur during running.

Figure 19:
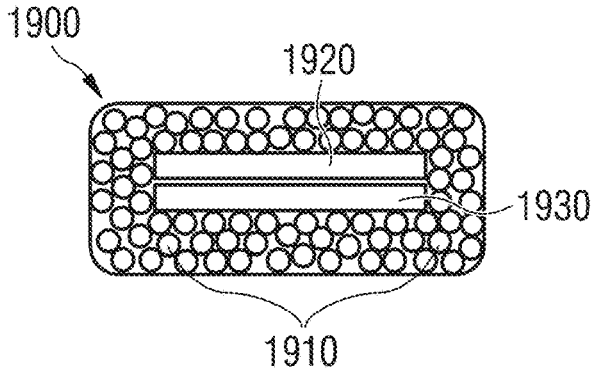
FIG. 19 is a schematic cross-sectional view in a ML direction through a midsole comprising a first and a second plate element which can perform a sliding movement relative to each other, according to certain embodiments of the present invention.

FIG. 19 shows a cross-section in medial-lateral direction through certain embodiments of a midsole 1900 according to the present invention comprising randomly arranged particles 1910 of an expanded material and which may be combined with the other aspects of the present invention described herein. As shown in FIG. 19, the whole midsole 1900 may comprise expanded material. It is, however, clear to the skilled person that this is merely one exemplary embodiment of a midsole 1900 according to the invention, and that in other embodiments only one or more partial regions of the midsole 1900 may comprise particles 1910 of expanded material. The midsole may further comprise a first plate element 1920 and a second plate element 1930 that may slide relative to each other. Certain embodiments may comprise a design in which the plate elements 1920 and 1930 may perform a sliding movement in several directions. In some embodiments, the two plate elements 1920 and 1930 are completely surrounded by the material of the midsole 1900, which may be advantageous with the expanded material 1910 of the midsole 1900. In other embodiments, however, the plate elements 1920 and 1930 are only partially surrounded by the material of the midsole 1900.

In some embodiments, the two plate elements 1920 and 1930 are arranged, as shown in FIG. 19, in the heel region of the midsole 1900 such that they are located directly opposite each other. In further embodiments, there is a lubricant or a gel or the like between the two plate elements 1920 and 1930, which counteracts wear of the plate elements 1920, 1930 caused by the sliding movement and facilitates sliding.

By the sliding movement of the two plate elements 1920 and 1930, such an arrangement may, for example, absorb or reduce, respectively, the horizontal shear forces acting on the movement apparatus of the wearer when he treads on the ground. This prevents wear of the joints and injuries of the wearer, in particular when he/she is running/walking fast. In other embodiments, the arrangement shown may also be located in a different region of the midsole 1900, for example, in order to further support the rolling of the foot during a step.

In further embodiments (not shown), one or both of the two plate elements 1920 and 1930 may comprise, in addition, a curved sliding surface. In certain embodiments, the curvature of the two sliding surfaces is chosen such that the two sliding surfaces match positively. By an appropriate selection of the degree and orientation of the curvature, it is possible to influence the direction in which the sliding movement of the first plate element 1920 relative to the second plate element 1930 may take place, for example, when treading on the ground. This, again, exerts an influence on the shear forces which are absorbed by the midsole or passed on to the wearer, respectively.

Further embodiments of such plate elements which may slide relative to each other and which may be advantageously combined with one or more of the embodiments described herein that belong to the invention are to be found in DE 102 44 433 B4 and DE 102 44 435 B4, the entire contents of each of which are incorporated herein in their entireties.

For the functionality described just now it is further advantageous if the material of the midsole 1900 counteracts the sliding movement of the two plate elements 1920 and 1930 by a restoring force. This restoring force may be due to the fact that the two plate elements 1920 and 1930 are surrounded by the material of the midsole 1900, in particular the expanded material 1910 of the midsole 1900, and that the material of the midsole 1900 is compressed by the movement of the first and the second plate element 1920 and 1930, respectively, in the regions which are adjacent to the two plate elements 1920 and 1930 in the direction of the sliding movement. Due to the elastic properties of the material, in particular of the expanded material 1910 of the midsole 1900, a restoring force is produced which counteracts the sliding movement of the first and the second plate element 1920, 1930, respectively, with no need for complicated mechanics to this effect.

Figure 20:
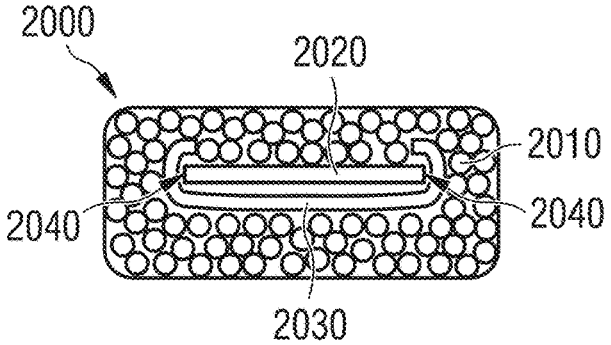
FIG. 20 is a schematic cross-sectional view in a ML direction through a midsole comprising a first and a second plate element which can perform a sliding movement relative to each other, according to certain embodiments of the present invention.

FIG. 20 shows a cross-section in medial-lateral direction of a variation of the embodiments discussed just now with a midsole 2000, which comprises randomly arranged particles 2010 of expanded material. The midsole comprises a plate element 2020 and a second, sled-shaped element 2030. The two elements 2020, 2030 may perform a sliding movement relative to each other. Due to the sled-shaped design of the second element 2030, a preferred direction for such a sliding movement is predetermined. In certain embodiments, however, there are voids 2040 between the first element 2020 and the second, sled-shaped element 2030 which also allow for small sliding movements of the two elements 2030 and 2040 relative to each other and which do not lie in the preferred direction mentioned above. By adapting the size of the voids 2030, the extent of such sliding movements which do not lie in the preferred direction may be individually adapted to the needs and requirements of the sole. So, very small voids 2040 allow for sliding movements of the two elements 2020 and 2030 almost exclusively in the preferred direction, which may lead to an increased stability of the sole. Larger voids 2040, however, facilitate noticeable sliding movements also in a non-preferred direction. This enables, for example, a better absorption of the horizontal shear forces by the sole when contacting the ground.

In the embodiments shown in FIG. 1, the cushioning element 110 further surrounds an element 120 at least partially, for example, a torsion or reinforcing element. In certain embodiments, the element 120 has higher deformation stiffness than the expanded material of the cushioning element 110. The element 120 hence may serve to further influence the elasticity and/or shear properties of the sole 100. In further embodiments, the element 120 may, for example, also be an element serving the optical design and/or an element for receiving an electronic component and/or any other functional element. In case the element 120 serves to receive a further element, such as, e.g., an electronic component, then it may have a hollow region which is accessible from the outside. As shown in FIG. 1, such a cavity could, e.g., be located in the region of the recess 140. In some embodiments, the element 120 is not bonded, for example by an adhesive bond, with the cushioning element 110. In particular, the element does not comprise, in certain embodiments, a bond with the expanded material of the cushioning material 110. Since the cushioning element 110 partially surrounds the element, such a bond for fixing the element 120 is not required. Therefore, also non-glueable materials may be used for manufacturing the shoe. In further embodiments, the element 120 may also be connected/bonded with the control element 130 in individual regions, for example by means of a bond such as, e.g., an adhesive bond, or be provided as one integral piece.

As shown in FIG. 1, the sole 100 further comprises a heel clip 150. The heel clip 150 may comprise a lateral finger and a medial finger which, independently from each other, encompass the lateral and the medial side of the heel. This allows a good fixation of the foot on the sole 100 without, at the same time, limiting the freedom of movement of the foot. In further embodiments, the heel clip 150 further comprises a recess in the region of the Achilles' tendon. This prevents a chafing or rubbing in particular of the upper edge of the heel clip 150 on the Achilles' tendon in the region above the heel. In certain embodiments, the heel clip 150 may further be bonded, e.g. by a bond, to the control element 130 and/or the element 120 or be provided together with this as one integral piece.

Figure 2:
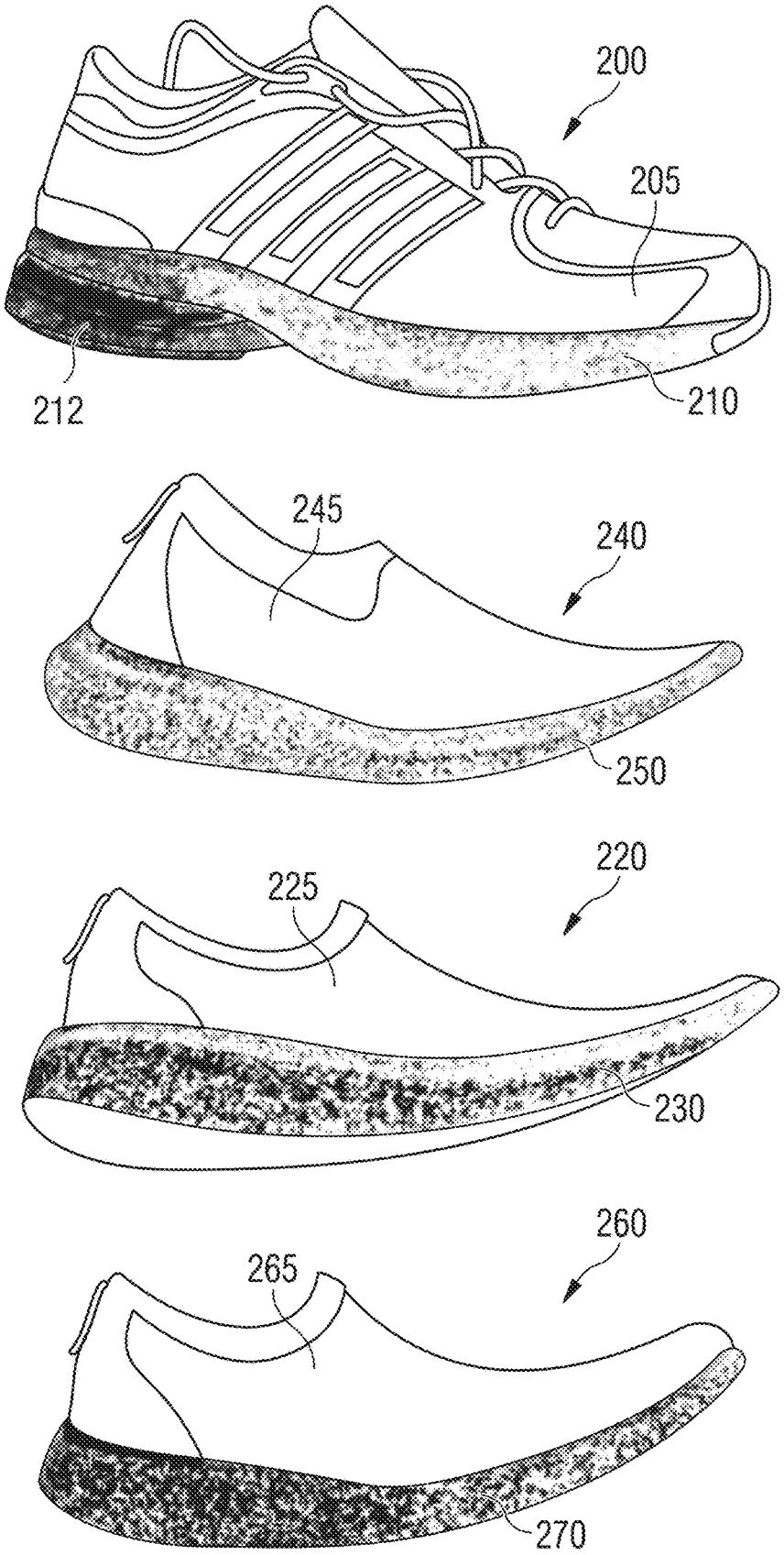
FIG. 2 are perspective views of shoes with different soles which were used for the measurements depicted in FIGS. 3-9, according to certain embodiments of the present invention.

FIG. 2 shows four different shoes 200, 220, 240 and 260 which were used for taking measurements of elasticity and shear properties of soles from various materials. The most important results of these measurements are summarized in the following FIGS. 3-9.

The shoe 200 is a shoe with an upper 205 as well as a shoe sole 210 and a sliding element 212, such as described, for example, in DE 102 44 433 B4 and DE 102 44 435 B4.

The shoe 220 comprises an upper 225 as well as a midsole 230 from eTPU which is surrounded by a frame from EVA. The EVA may, for example, be a compression molded 020 55C CMEVA which has a density of 0.2 g/cm$^3$ and a hardness of 55asker C.

The shoe 240 comprises an upper 245 as well as a midsole 250 of EVA.

Furthermore, the shoe 260 comprises an upper 265 as well as a midsole 270 of eTPU.

Figure 3A:
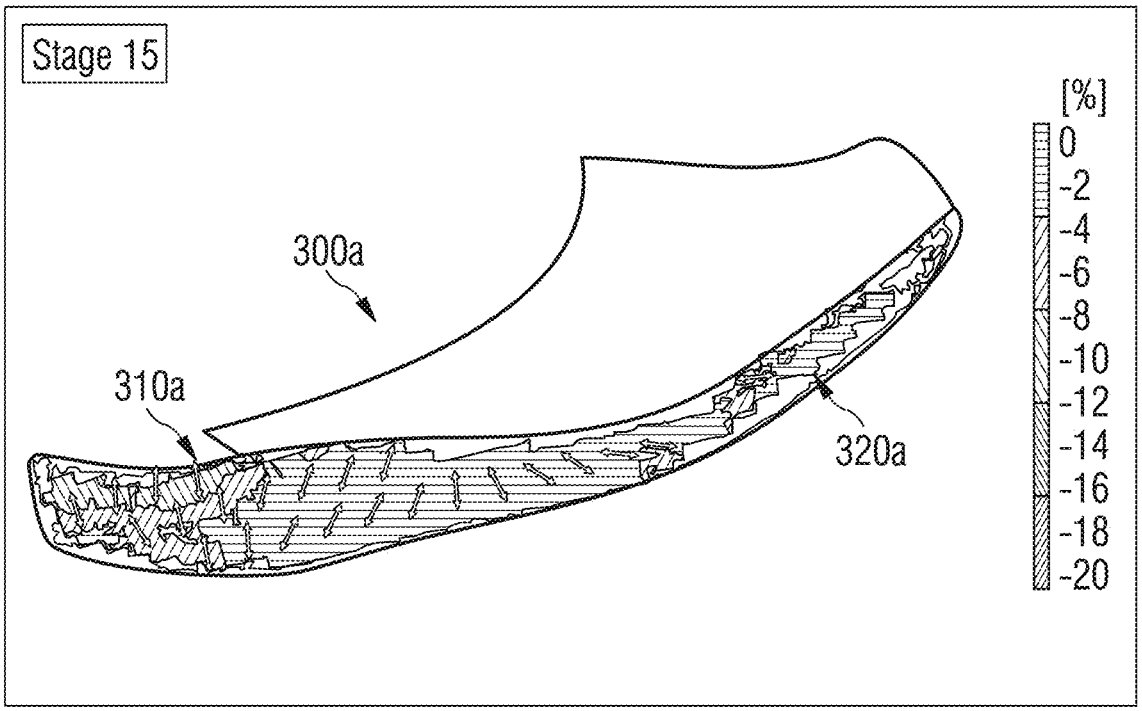
FIGS. 3*a*-*b* are images comparing the vertical compression of a midsole made from eTPU and a midsole made from EVA when the foot touches the ground.
Figure 3B:
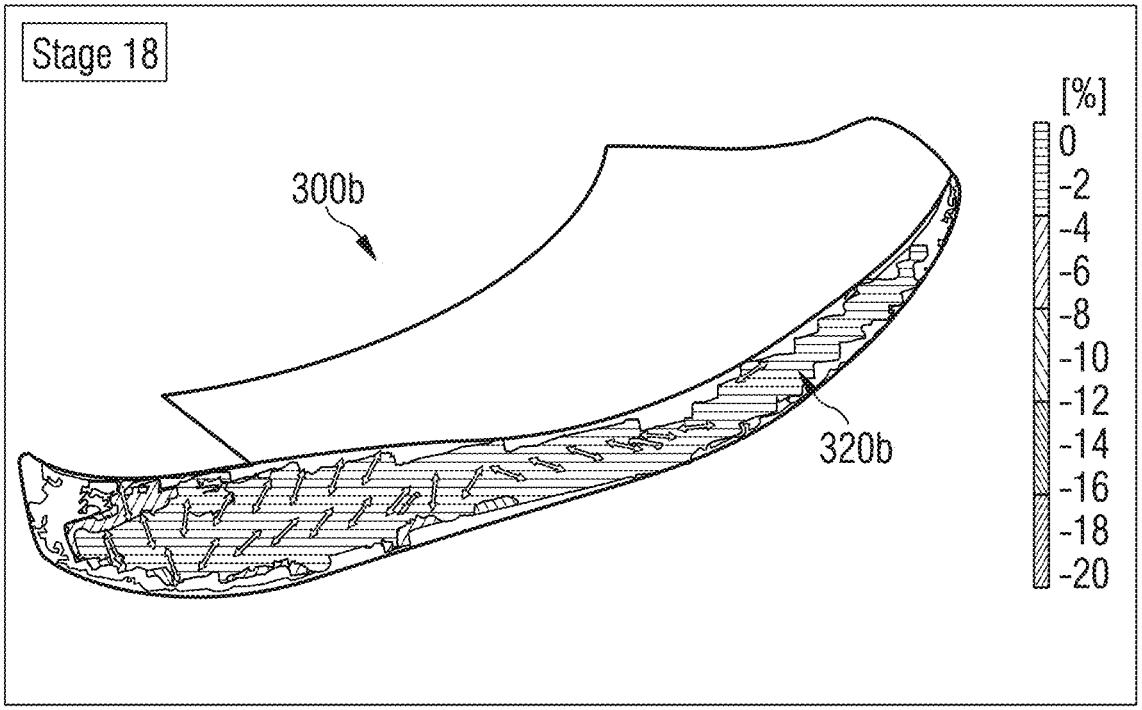
Figure 4:
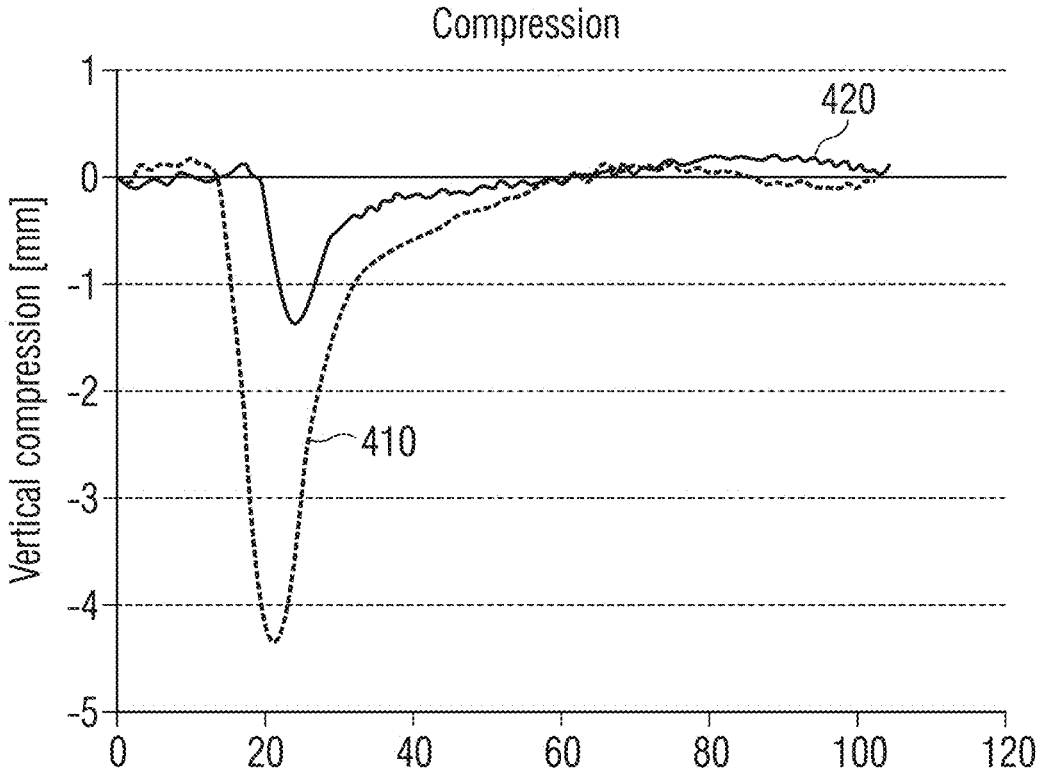
FIG. 4 is a chart comparing measurements of the vertical compression of a midsole made from eTPU and a midsole made from EVA during an entire step cycle.

FIGS. 3*a*, 3*b* and 4 show the vertical (i.e. the direction from foot to ground) compression of the soles of eTPU (shoe 260) and EVA (shoe 240).

For measuring these and further discussed properties of the various materials and sole designs, for each measurement a large number (>100) of pictures, referred to as "stages", were taken in the course of a step cycle. These are continuously numbered starting from 1. For each measurement there is hence a one-to-one correspondence between the number or "stage" of a take and the point in time of this take within the respective step. However, it has to be noted that between different measurements there may be a certain time offset for the individual stages, i.e. the stages with an identical number from various measurements do not necessarily correspond to the same point in time during the step measured in the respective measurement.

Pictures 300*a* and 300*b* of FIGS. 3*a* and 3*b* were taken during the heel touching the ground. FIGS. 3*a* and 3*b* show the compression in percent of the respective midsole regions compared to the unloaded state of the sole. As expected, no compression occurs in the forefoot region (cf. 320*a*, 320*b*) while the ground is touched by the heel. In the heel region, however, noticeable compressions are visible on the sole of eTPU (cf. 310*a*). The measurements therefore show that eTPU yields significantly more strongly under vertical load than EVA. Furthermore, the energy stored during compression of the eTPU sole is essentially restored to the runner in the course of the step. This increases the running efficiency significantly.

This is also confirmed by FIG. 4. On the horizontal axis, the number of the respective stage, i.e. the time, is shown, and on the vertical axis, the vertical compression of the midsole is shown. The measured values 410 for the sole 270 from eTPU are shown as well as the measured values 420 for the sole 250 from EVA. At the time of the maximum vertical load, the EVA midsole 250 may be depressed only by about 1.3 mm, while the eTPU midsole 270 may be depressed by about 4.3 mm. Generally, the values of the vertical compression for eTPU compared to those of EVA range from 2:1 to 3:1, and in some embodiments, even above this.

Figure 5A:
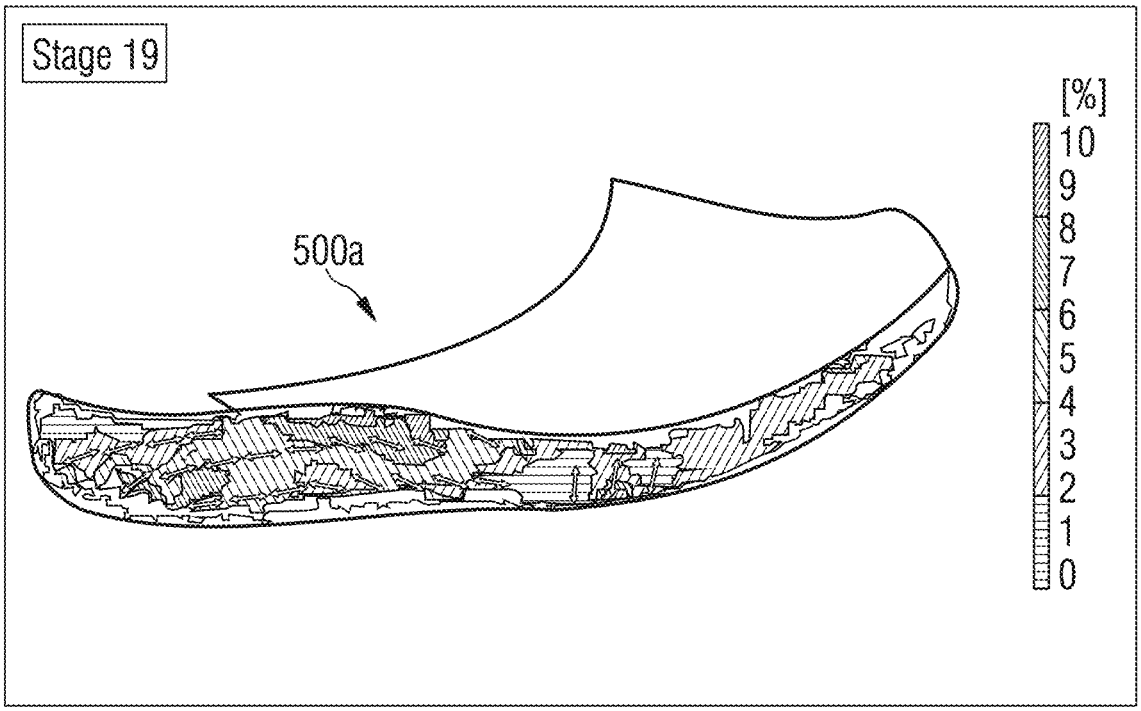
FIGS. 5*a*-*b* are images comparing local material stretch in the lateral side wall of a midsole made from eTPU and a sole made from EVA during a rolling motion of the foot from the heel region to the forefoot region during a step.
Figure 5B:
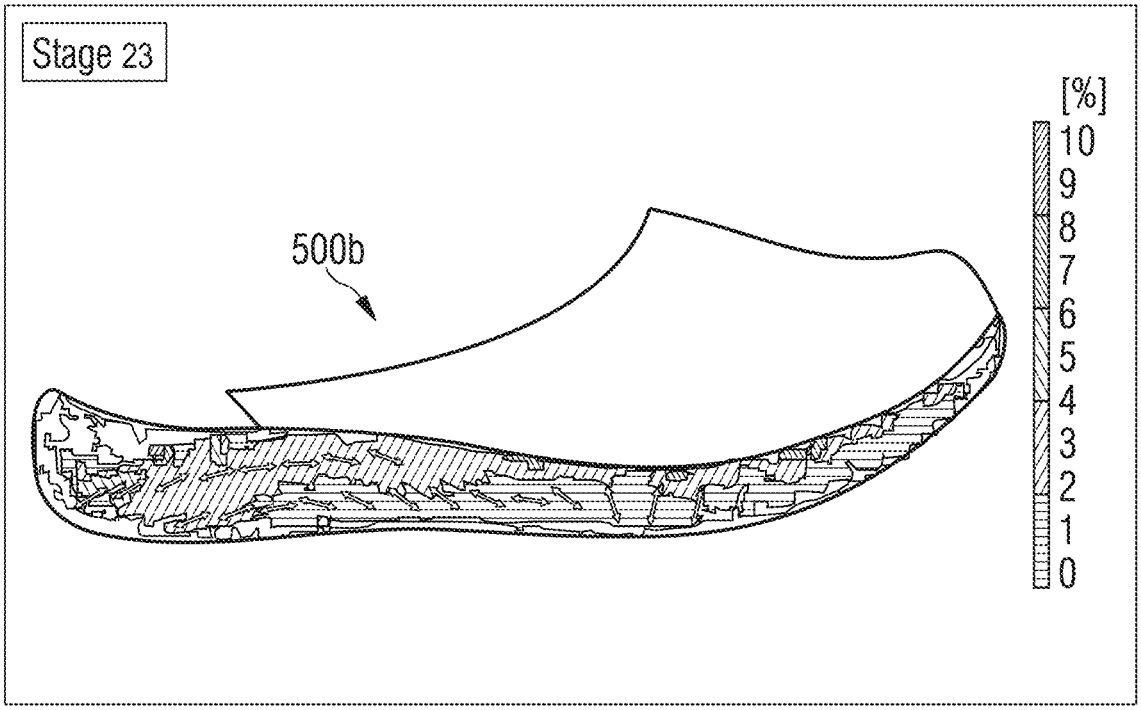

FIGS. 5*a* and 5*b* show the local material stretch of the midsole material compared to the unloaded state of the sole within the lateral side wall of the eTPU midsole 270 (measurement 500*a*) and the EVA midsole 250 (measurement 500*b*), also at a moment when the heel touches the ground. In addition to a percent indication of the material stretch compared to the unloaded state of the sole, the pictures of FIGS. 5*a* and 5*b* indicate, however, also the direction of the material stretch in the form of stretch vectors. From the pictures, it may be seen that in the eTPU midsole 270, significantly greater material stretches occur than in the EVA midsole 250. This is due to the better shear capacity of eTPU compared to EVA. Therefore, eTPU is particularly appropriate for manufacturing a cushioning element for absorbing shear forces during running. In the example discussed here, the material stretch with eTPU is about 2-3 times higher than with EVA. More precisely, the material stretch of eTPU is on average a stretch of 6-7%; the maximum stretch is 8-9%; the material stretch for EVA is on average a stretch of 2%; the maximum stretch is 3-4%.

Furthermore, the measurements reveal that the material stretch in the lateral side wall of the eTPU midsole 270 and of the EVA midsole 250 follow the natural shape of the metatarsal arch during running, i.e. the shoe follows the rolling movement of the foot. This is advantageous for the wear comfort and fit of the foot.

Figure 6A:
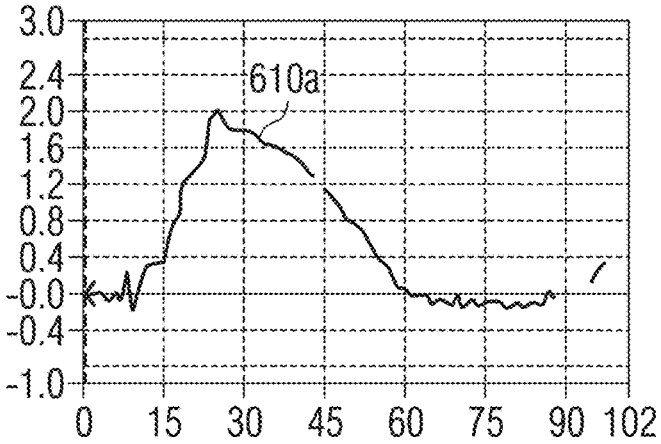
FIGS. 6*a*-*c* are charts comparing the relative displacement of two measurement points at the opposite ends of the measurement sections represented in FIGS. 7*a*-7*c* during a complete step cycle for three different soles.
Figure 7A:
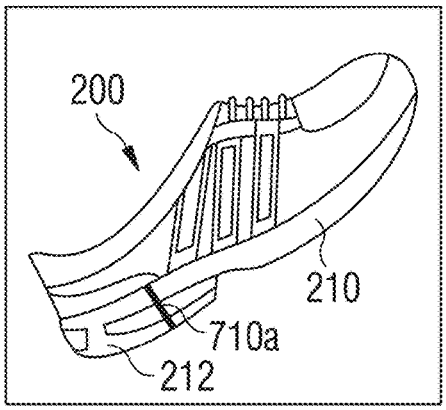
FIGS. 7*a*-*c* are perspective views of some of the shoes of FIG. 2 showing the location of measurement points at the ends of the measurement sections delineated in FIGS. 7*a*-7*c*, which are used for the measurements depicted in FIGS. 6*a*-6*c*.
Figure 6B:
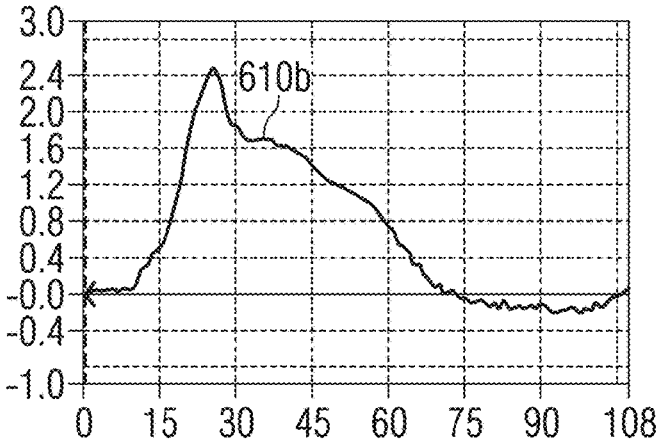
Figure 7B:
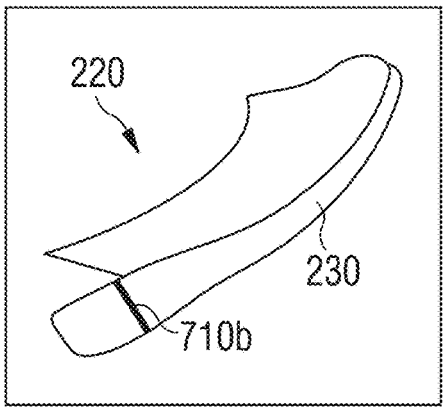
Figure 6C:
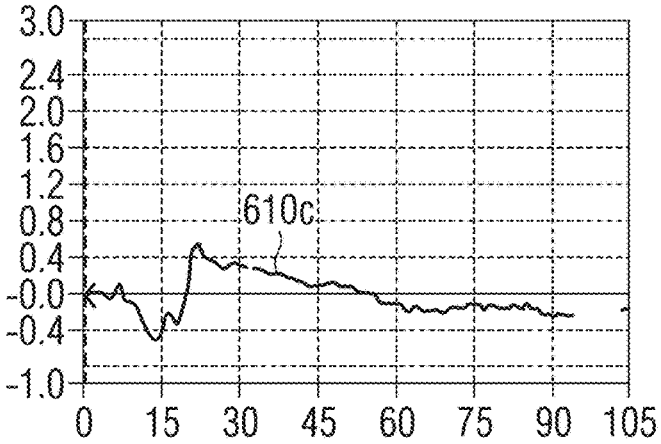
Figure 7C:
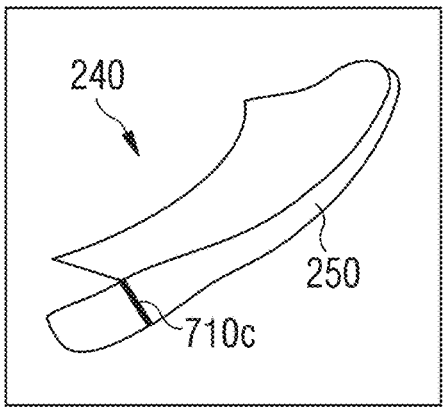

FIGS. 6*a*-6*c* show the measurements 610*a*, 610*b* and 610*c* of the relative offset of two measurement points in millimeters, which are each located at the opposite ends of the measurement sections 710*a*, 710*b* and 710*c* shown in FIGS. 7*a*-7*c*. The measurements 610*a* 610*b* and 610*c* each comprise a complete step cycle. In FIGS. 7*a*-*c*, the shoes used for the respective measurements are shown in a starting position.

FIGS. 6*a*, 7*a* show the measurement results and the measurement points for a shoe 200 with a shoe sole 210 and a sliding element 212, as described in DE 102 44 433 B4 and DE 102 44 435 B4.

FIGS. 6*b*, 7*b* show the measurement results and the measurement points for the shoe 220 with a midsole 230 of eTPU and an EVA rim.

FIGS. 6*c*, 7*c* show the measurement results and the measurement points for the shoe 240 with an EVA sole 250.

It is clearly visible that the sliding element 212 of the shoe 200 and the eTPU sole with EVA rim 230 allow significantly greater offsets between the two measurement points than the EVA midsole 250. This means a better shear capacity of the lower midsole surface relative to the upper midsole surface and thus a better absorption capacity of the shear forces occurring during running. It is to be noticed that the shoe 220 which is simpler in construction allows offset values of up to about 2.5 mm (cf. FIG. 6*b*), while the shoe 200 with the sliding element 212 allows only offset values of up to about 2 mm (cf. FIG. 6*a*). The shoe 240 with EVA midsole 250, in contrast, allows only offset values of up to about 0.5 mm (cf. FIG. 6*c*).

Figure 8A:
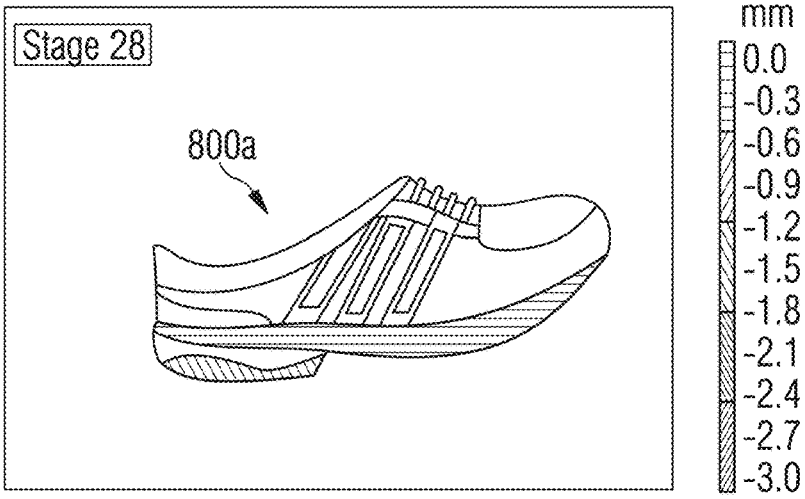
FIGS. 8*a*-*c* are images comparing the horizontal shear effect exerted on the sole material of three different midsoles when touching the ground with the lateral heel region.
Figure 8B:
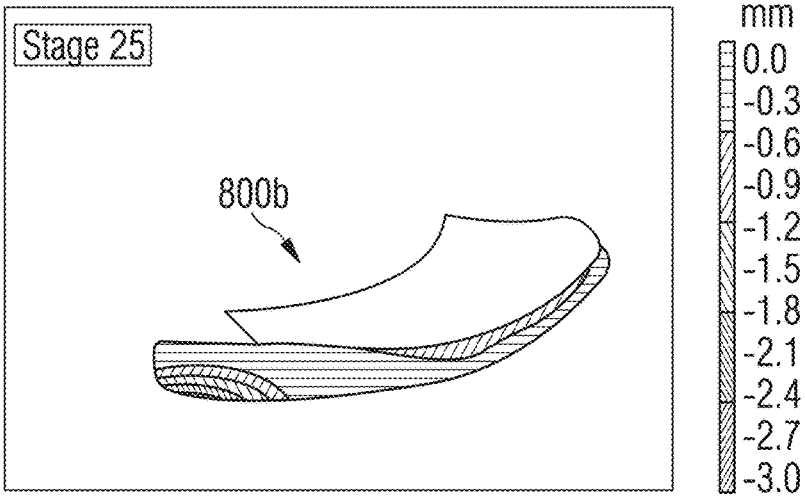
Figure 8C:
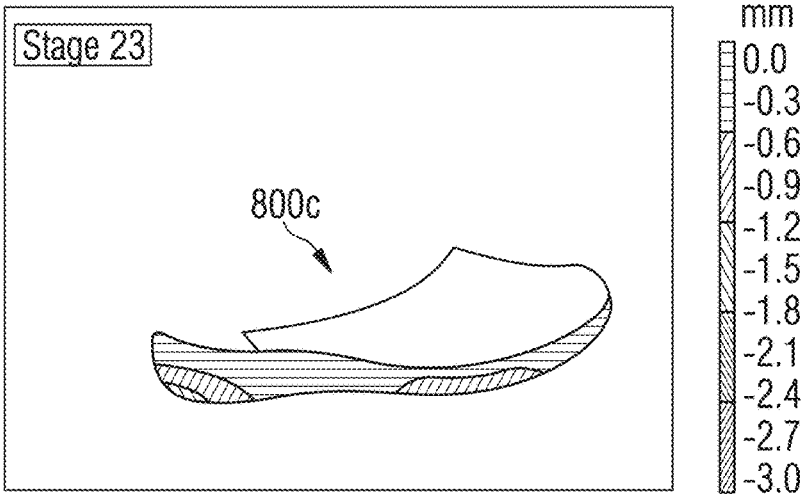
Figure 9:
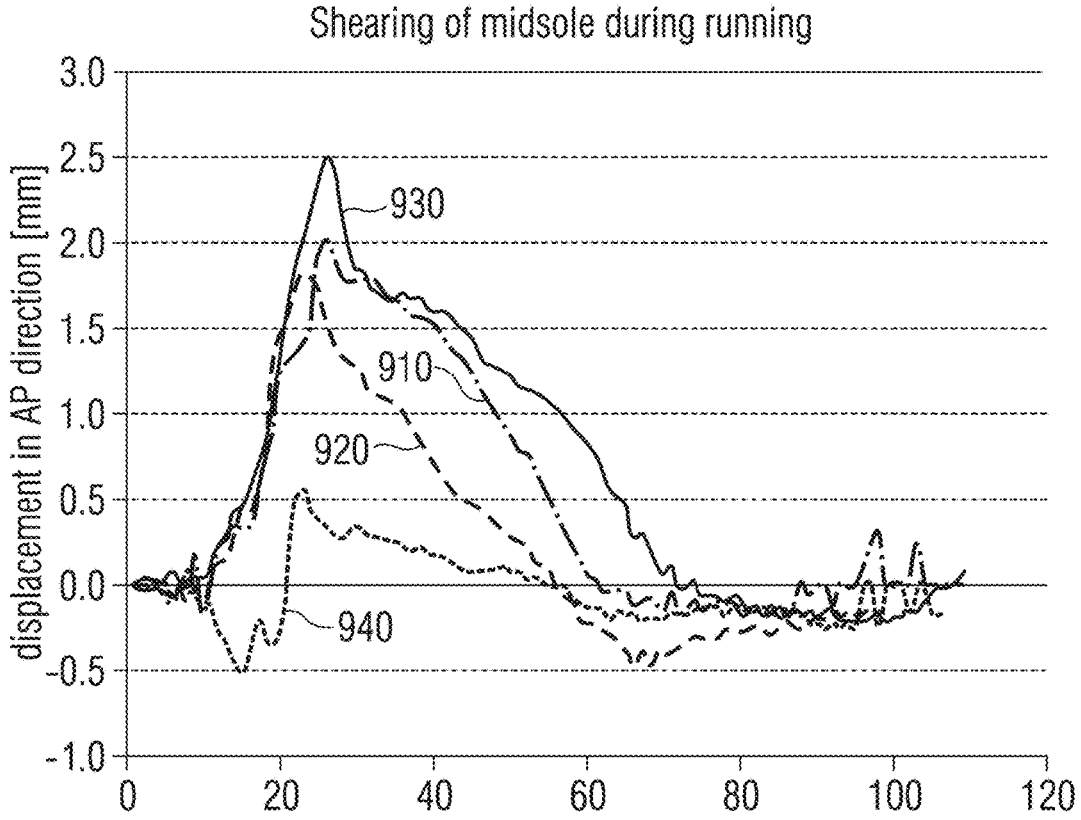
FIG. 9 is a chart comparing the shear effects in the heel region of the sole material of different midsoles in longitudinal direction (AP direction) during an entire step cycle.

The FIGS. 8*a*-8*c* show further measurements of the shear behavior of the shoe 200 with the sliding element 212 (measurement 800*a*), of the shoe 220 with eTPU midsole with EVA rim 230 (measurement 800*b*), and of the shoe 240 with EVA midsole 250 (measurement 800*c*). What is shown is the local offset of the sole material compared to the unloaded state at a moment when the heel touches the ground.

It is clearly visible that the shoe 200 with the sliding element 212 and the shoe 220 with eTPU midsole with EVA rim 230 have a substantially higher shear capacity in the region of the heel than the shoe 240 with EVA midsole 250.

FIG. 9 again shows results of measurements of the shearing in the midsole material in longitudinal direction (AP direction) during a complete step cycle for four different shoes.

The curve 910 shows again the measurement results of FIG. 6*a* for the shoe 200 with the sliding element 212, with a maximum shearing of about 2 mm when the heel touches the ground. The curve 930 again shows the measurement results of FIG. 6*b* for the shoe 220 with eTPU midsole with EVA rim 230 with a maximum shearing of about 2.5 mm when the heel touches the ground. The curve 940 again shows the measurement results of FIG. 6*c* for the shoe 240 with EVA midsole 250 with a maximum shearing of about 0.5 mm when the heel touches the ground. The curve 920, finally, shows the measurement results of a measurement carried out in the same way for the shoe 260 with eTPU midsole 270 with a maximum shearing of about 1.8 mm when the heel touches the ground.

One can thus recognize that the shoe 260 with the eTPU midsole 270 and in particular the shoe 220 with eTPU midsole with the EVA rim 230 have a very good shear capacity and thus are principally well-suited for the construction of midsoles.

FIGS. 10-13 show further measurements of the shear capacity of differently designed soles.

FIGS. 10*a*-10*d* show measurements of the changes in length of measurement sections of which one is arranged in longitudinal direction (AP direction) and one in medial-lateral direction (ML direction) in the heel region of the sole during a step cycle. These changes in length provide information on the plantar shear capacity of the respective sole.

Figure 10A:
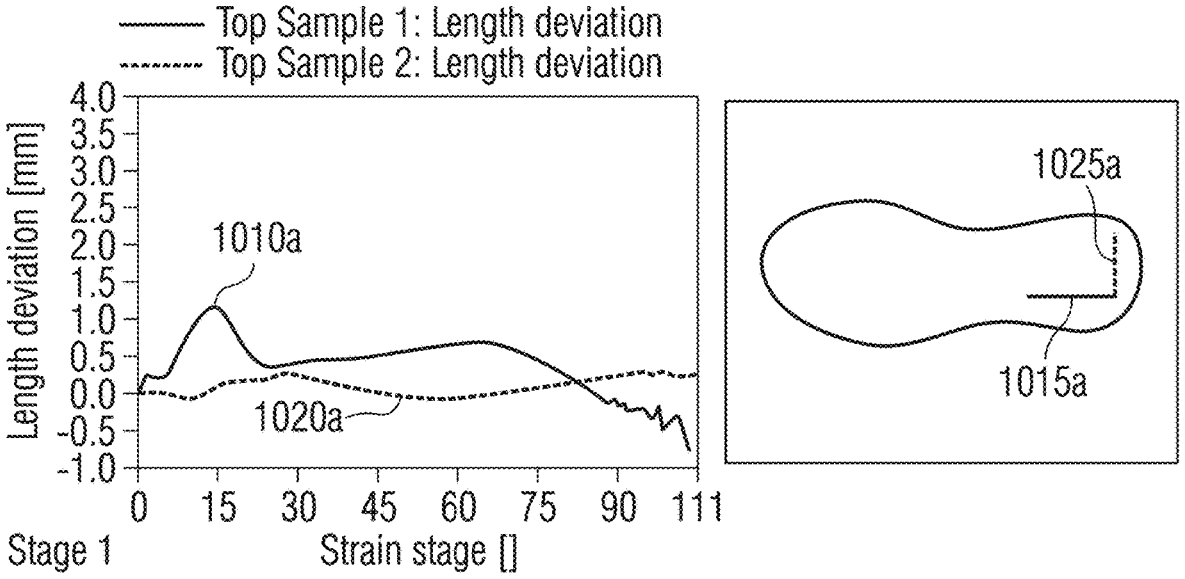
FIGS. 10*a*-*d* are charts illustrating measurements of the shear effects in the heel region of the sole material of various midsoles in longitudinal direction (AP direction) and in medial direction (ML direction) during an entire step cycle.

FIG. 10*a* shows the change in length 1010*a* of the measurement section 1015*a* extending in AP direction, and the change in length 1020*a* of the measurement section 1025*a*, which extends in ML direction, for a shoe with an EVA midsole without outsole, as, e.g., the shoe 240. The measurements indicate a maximum change in length of about 1.2 mm in AP direction and of about 0.3 mm in ML direction.

Figure 10B:
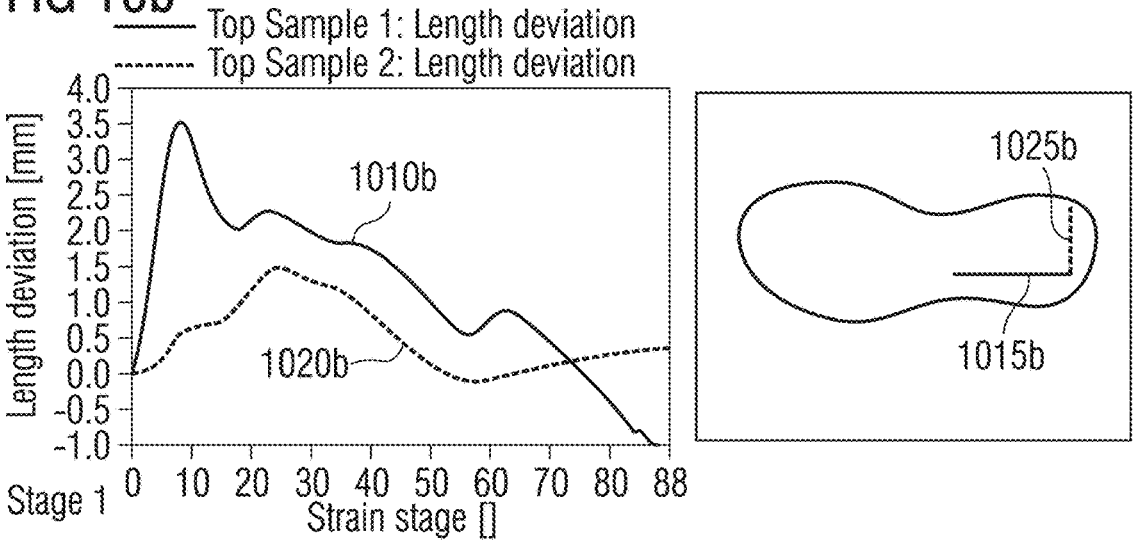

FIG. 10*b* shows the change in length 1010*b* of the measurement section 1015*b* extending in AP direction and the change in length 1020*b* of the measurement section 1025*b* extending in ML direction for a shoe with an eTPU midsole without outsole, as, e.g., the shoe 260. The measurements show a maximum change in length of about 3.5 mm in AP direction and of about 1.5 mm in ML direction.

Figure 10C:
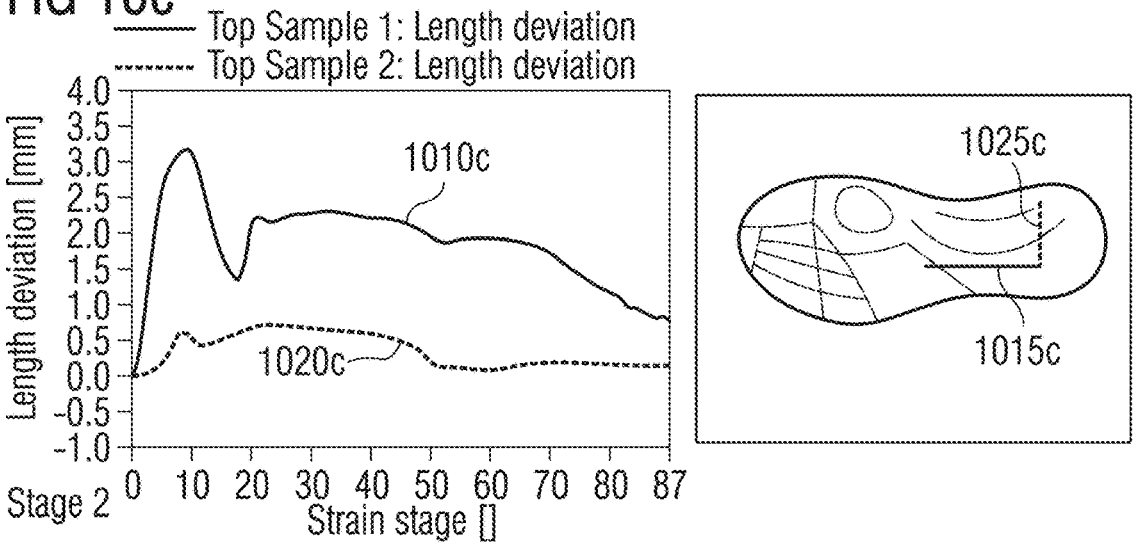

FIG. 10*c* shows the change in length 1010*c* of the measurement section 1015*c* extending in AP direction and the change in length 1020*c* of the measurement section 1025*c* extending in ML direction for a shoe with a sliding element, as for instance the shoe 200. The measurements show a maximum change in length of about 3.2 mm in AP direction and of about 0.7 mm in ML direction.

Figure 10D:
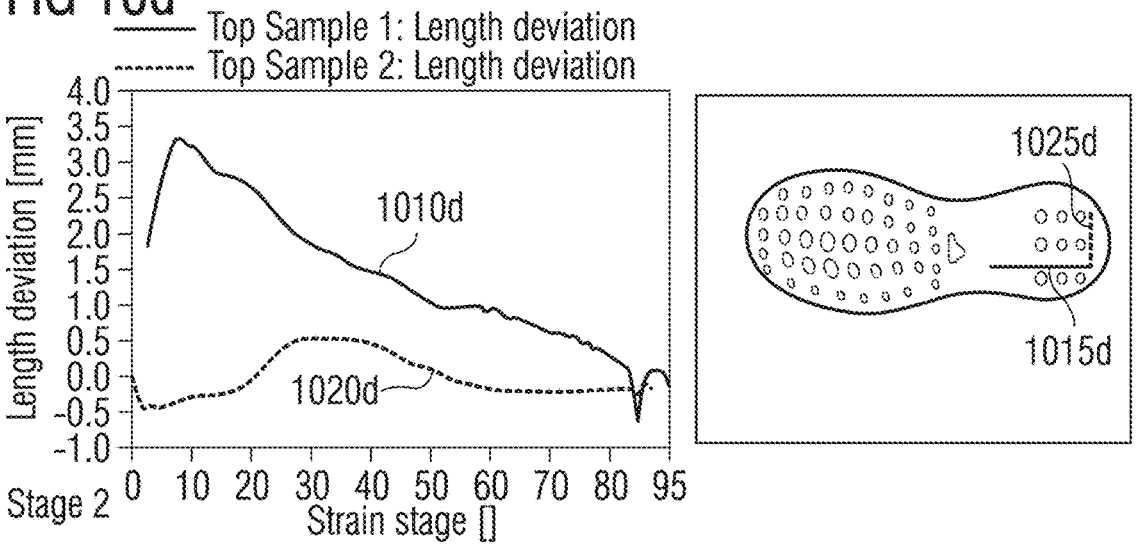

FIG. 10*d* shows the change in length 1010*d* of the measurement section 1015*d* extending in AP direction and the change in length 1020*d* of the measurement section 1025*d* extending in ML direction for the embodiments of a shoe 1400 according to FIGS. 1 and 14*a*-14*c* comprising a midsole, which comprises eTPU, as well as a control element 1450 (cf. below) provided as an outsole. The measurement show a maximum change in length of about 3.4 mm in AP direction and a negative change in length of about 0.5 mm in ML direction. In particular, the negative change in length in ML direction means a very good stability of the shoe in the midfoot region which reflects the influence of the medial reinforcement 1455 of the control element 1450.

Figure 11:
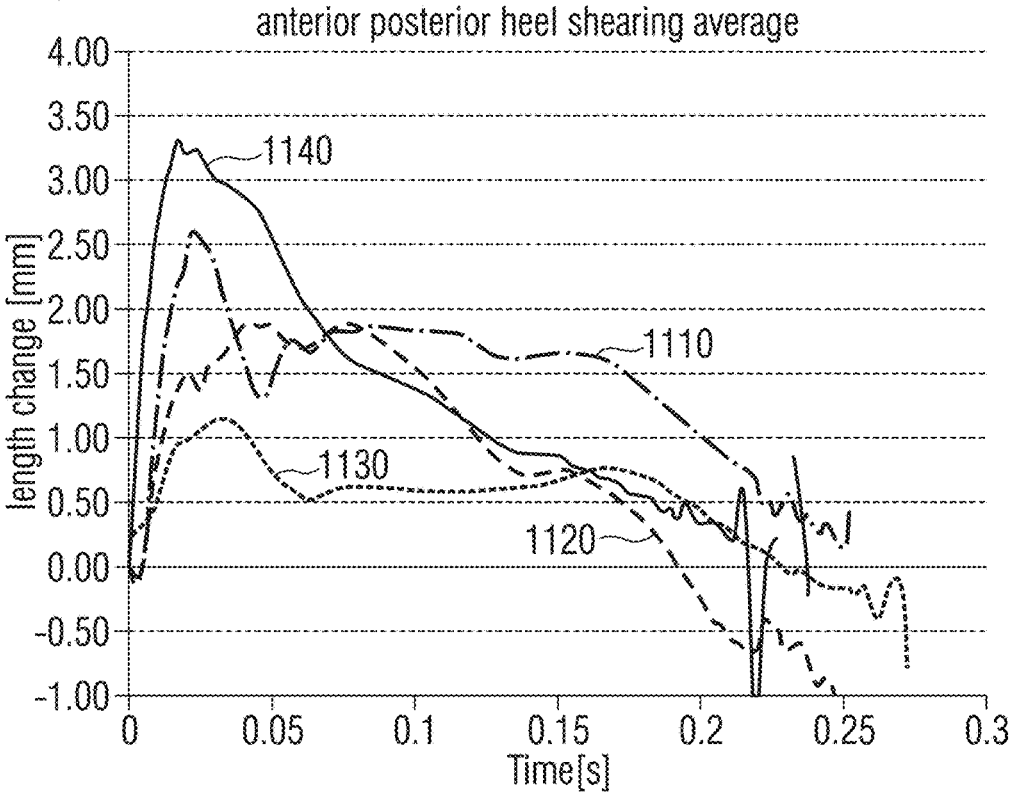
FIG. 11 is a chart comparing values of several measurements of the shear effects in the heel region of the sole material of respective different midsoles in longitudinal direction (AP direction) during an entire step cycle.
Figure 12:
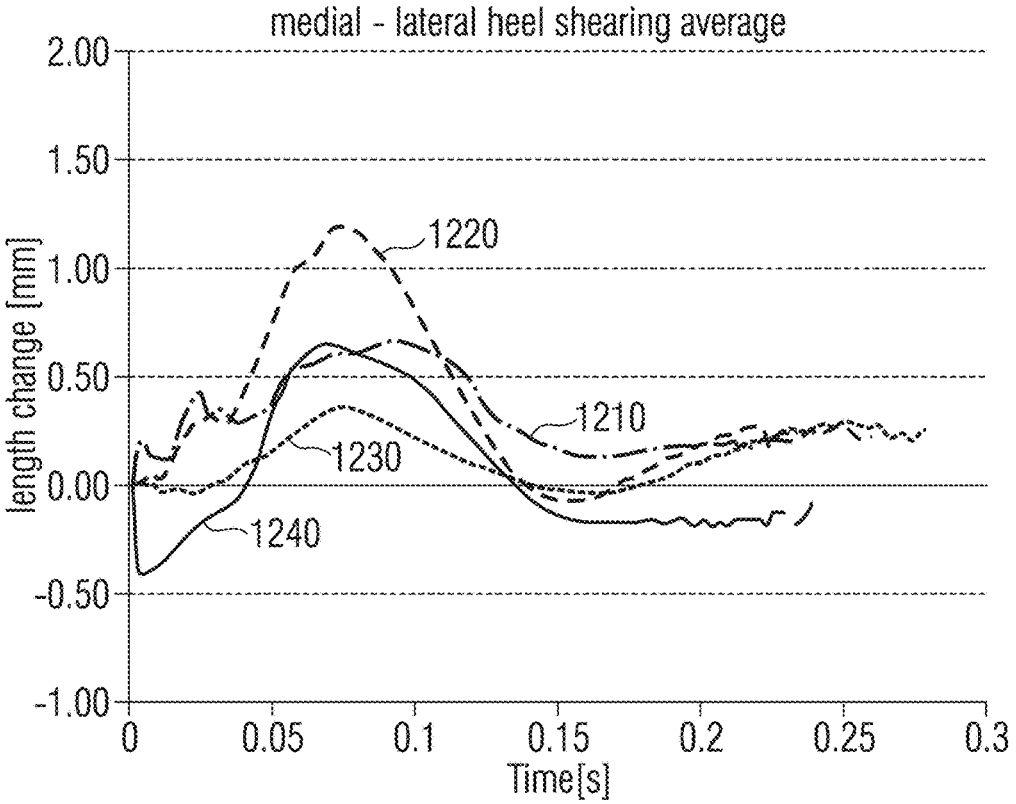
FIG. 12 is a chart comparing values of several measurements of the shear effects in the heel region of the sole material of respective different midsoles in medial-lateral direction (ML direction) during an entire step cycle.

FIGS. 11 and 12 show the average values of a series of measurements conducted analogously to the measurements shown in FIGS. 10*a*-10*d*.

Figure 14A:
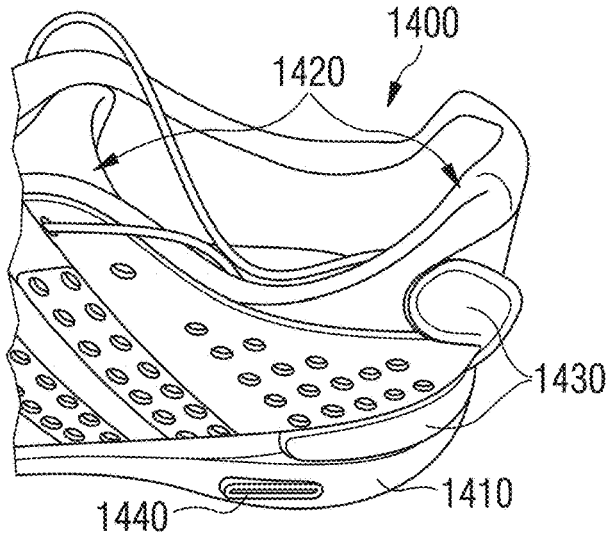
FIGS. 14*a*-*c* are perspective views of a shoe with a sole, according to certain embodiments of the present invention.
Figure 14B:
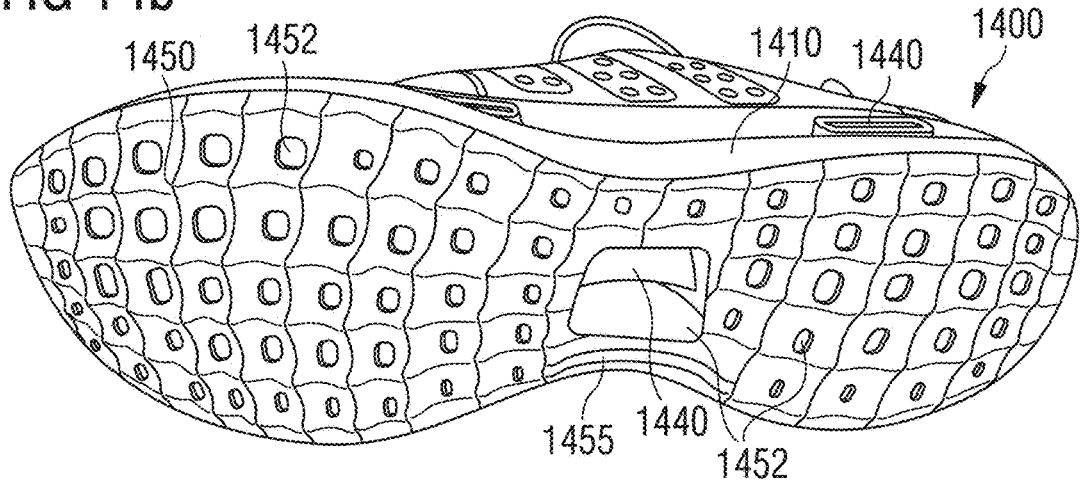
Figure 14C:
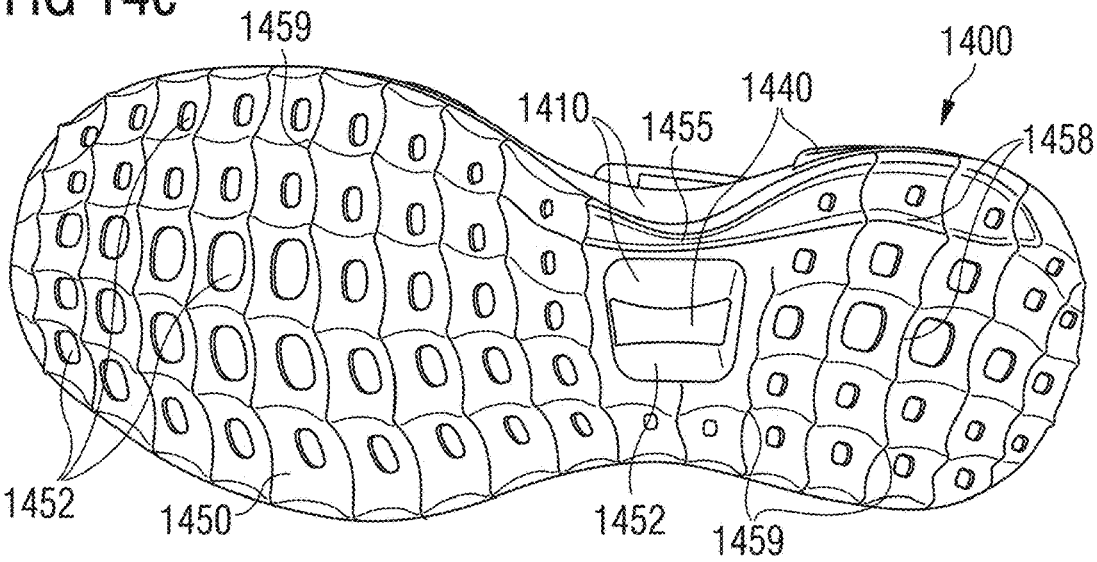

FIG. 11 shows the average change in length of the measurement section extending in AP direction during a complete step cycle for a shoe with a sliding element, as, for example, the shoe 200 (cf. curve 1110), for a shoe with an eTPU midsole, as, for example, the shoe 260 (cf. curve 1120), for a shoe with an EVA midsole, as, for example, the shoe 240 (cf. curve 1130) and for the shoe 1400 according to FIGS. 14*a*-14*c* (cf. curve 1140).

FIG. 12 shows the average change in length of the measurement section extending in ML direction during a complete step cycle for a shoe with a sliding element, as, for example, the shoe 200 (cf. curve 1210), for a shoe with an eTPU midsole, as, for example, the shoe 260 (cf. curve 1220), for a shoe with an EVA midsole, as, for example, the shoe 240 (cf. curve 1230), and for the shoe 1400 according to FIGS. 14*a*-14*c* (cf. curve 1240).

As may be inferred from FIGS. 11 and 12, the shoe 1400 according to certain embodiments has, with a maximum change in length in AP direction of more than 3 mm, the best shear capacity of all four tested shoe types. At the same time, the shoe 1400 shows a sufficient stability in ML direction, as can be seen from FIG. 12. As shear forces occur during running mainly in AP direction, and since a bending/slipping of the foot in ML direction is to be avoided as far as possible, this combination of properties of the shoe may be advantageous for certain applications.

In further embodiments, the cushioning element enables a shearing motion in AP direction of a lower sole surface relative to an upper sole surface of more than 1 mm, and may further enable a shearing motion in longitudinal direction of a lower sole surface relative to an upper sole surface of more than 1.5 mm, and still further enable a shearing motion in longitudinal direction of a lower sole surface relative to an upper sole surface of more than 2 mm. A selection between different values of the shear capacity of the cushioning element enables the shoe sole to adapt individually to the needs and physiological conditions of a runner. The values discussed herein serve the skilled person only as a guideline in order to obtain an impression of typical values of the shear capacity of a cushioning element. In individual cases, these values ideally have to be specifically adapted to the wishes and needs of the wearer.

Figure 13A:
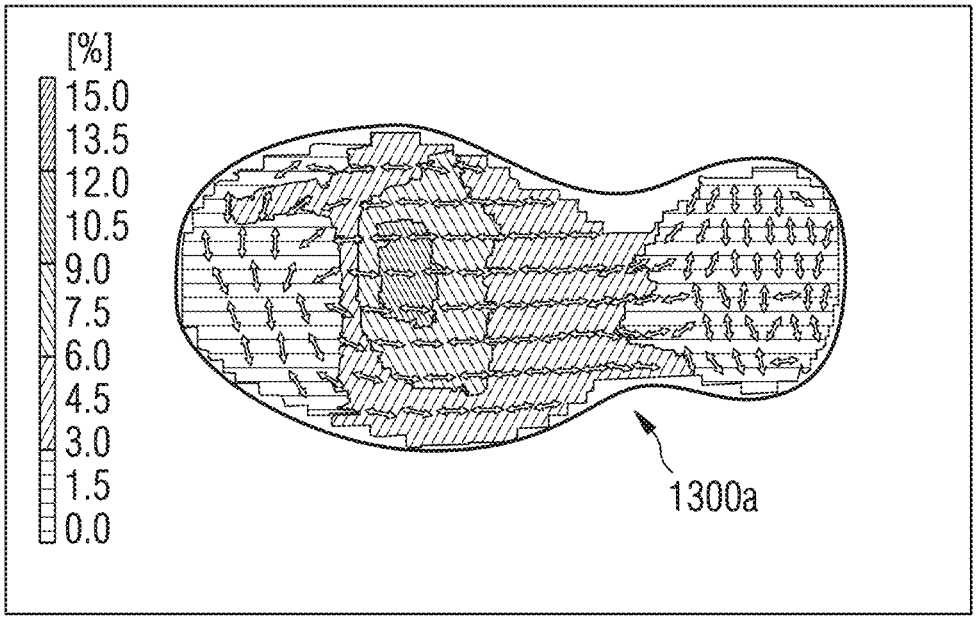
FIGS. 13*a*-*e* are images comparing the plantar shearing effect on the sole material of different midsoles, at the end of a step, when the foot is pushed off the ground in the forefoot region (cf.
Figure 13B:
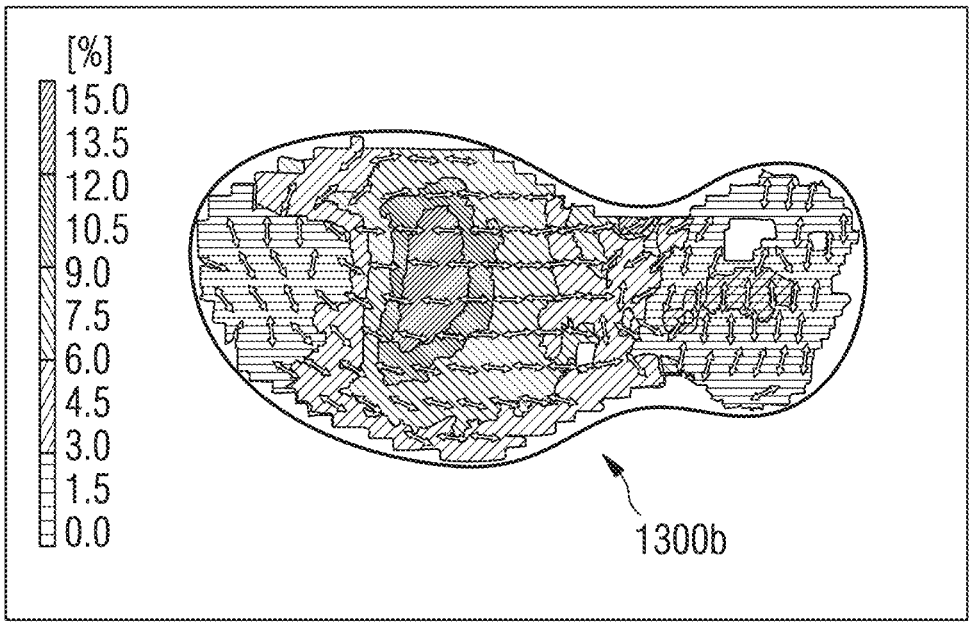
Figure 13C:
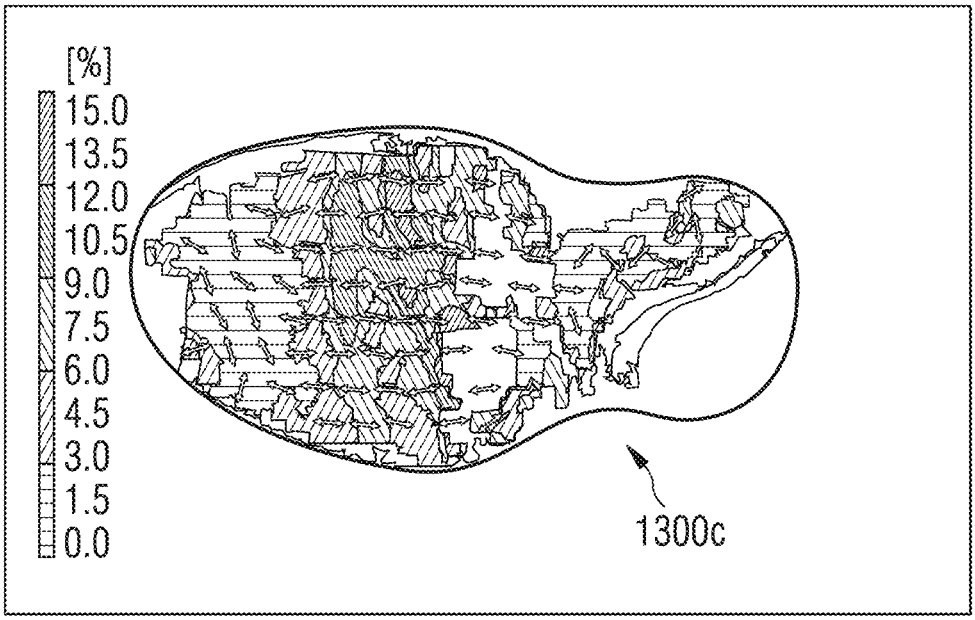
Figure 13D:
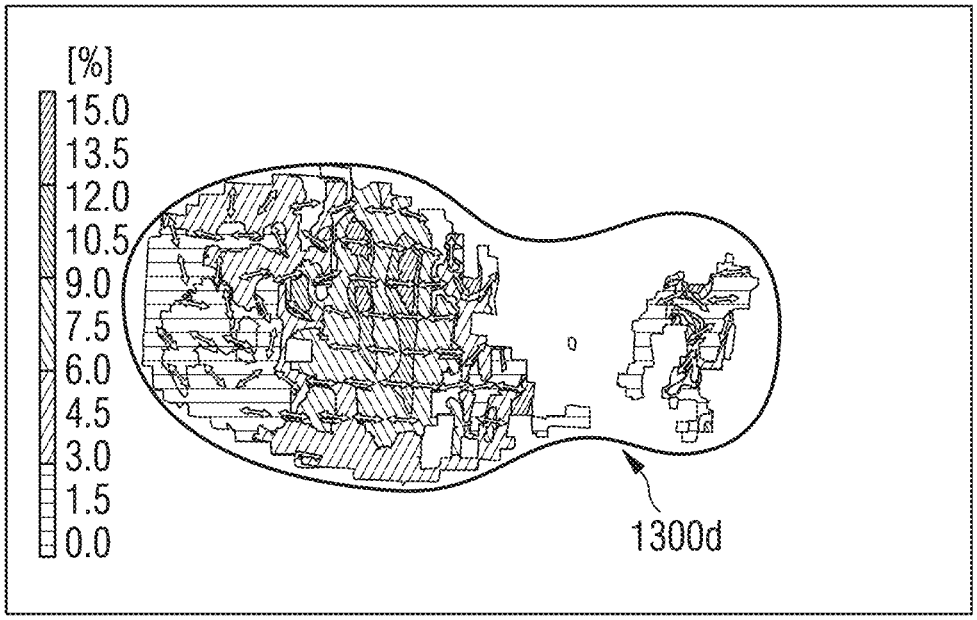
Figure 13E:
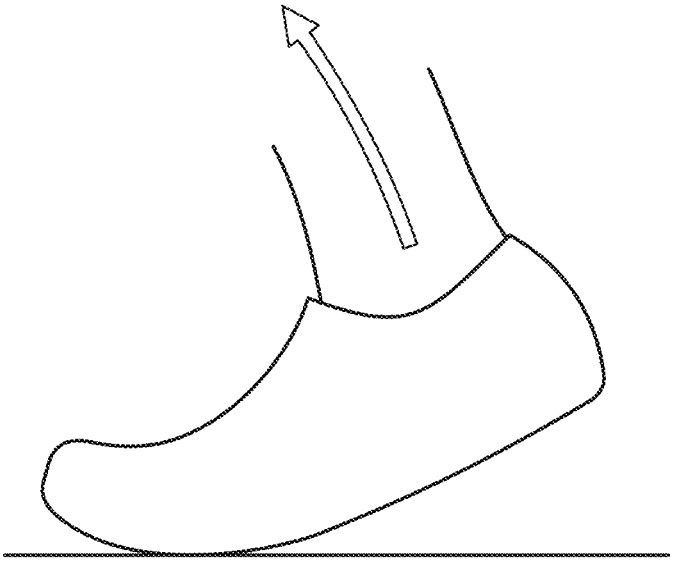

FIGS. 13*a*-13*d* show the plantar material stretch in the sole of various shoes in percentages, compared to the unloaded state of the shoe, at the moment when the foot is pushed off the ground via the forefoot, as schematically shown in FIG. 13*e*. FIGS. 13*a*-13*d* furthermore show the stretch vectors which locally indicate the direction of the material stretch. FIG. 13*a* shows a measurement 1300*a* for the shoe 240 with the EVA midsole 250, FIG. 13*b* shows a measurement 1300*b* for the shoe 260 with the eTPU midsole 270. FIG. 13*c* shows a measurement 1300*c* for a shoe with a sliding element, as, for example, the shoe 200, and FIG. 13*d* shows a measurement 1300*d* for the embodiments of the shoe 1400 according to FIGS. 1 and 14*a*-14*c*, which comprises a midsole 1410 comprising eTPU, as well as the control element 1450 provided as an outsole (cf. below).

As can clearly be seen from the figures, in this position of the foot/shoe (i.e. when pushing the foot off the ground over the forefoot region, cf. FIG. 13*e*) the main load and deformation of the material of the shoes 240 and 260 occurs locally in the middle of the forefoot region (cf. FIG. 13*a* and FIG. 13*b*) (in other positions of the foot, the main load and deformation can also be observed in the heel region). In the case of the shoe with the sliding element (for example, the shoe 200) and the shoe 1400, however, the material stretches follow the shape of the outsole. In FIG. 14*c*, in particular, the structure of the outsole 1450 with its openings 1452, elevations 1458, and protrusions 1459 can be seen. Furthermore, FIG. 13*d* shows that almost all of the stretch vectors in the forefoot region extend parallel in AP direction, i.e. the material stretches almost exclusively in AP direction, while it shows a good stability in ML direction. This is desirable for a dynamic push-off of the foot without losing stability. In case of insufficient stability of the sole in ML direction, the foot would otherwise be in danger of slipping sideways or bending, in particular at a higher running speed and, for instance, in a curve or on uneven terrain.

The control element 1450, e.g. in the form of an outsole, contributes to forming predefined zones where a specific shearing- and/or stretching behavior or a specific stability is required. The design of the control element 1450 may be adapted to the requirements of each sport. Linear sports have different requirements concerning the shearing behavior and stability of the sole than, for example, lateral sports. Therefore, the control elements 1450 and sole concepts may be individually designed for specific sports. For example, for sports like (indoor) football, basketball, or running sports, the best/most important shearing and stability zones may be determined and individually adapted. For example, in many fields of application, such shearing and/or stretching zones are located beneath the big toe and in the heel region. Furthermore, by means of the aspects pertaining to the invention which are described herein, soles may be manufactured which may ideally imitate the rolling of the foot like when walking barefoot.

FIGS. 14*a*-14*c* show certain embodiments of the shoe 1400 with the cushioning element 1410 provided partially as a part of a midsole or as a midsole, said cushioning element comprising randomly arranged particles of expanded material, in particular particles of eTPU, and the control element 1450 provided as part of an outsole or as an outsole, which reduces the shear capacity of the midsole 1410 in the medial region of the midfoot compared to the lateral region of the heel. In addition, the shoe shown in FIGS. 14*a*-14*c* comprises an upper 1420. In some embodiments, the shoe 1400 further comprises a heel clip 1430 as well as an additional torsion or stiffening element 1440, as already discussed above in connection with FIG. 1 and the corresponding embodiments.

In further embodiments, the control element 1450 which is provided as an outsole does not comprise expanded material. In these embodiments, the control element may be made from rubber, thermoplastic urethane, textile materials, PEBA, foils and foil-like materials, or a combination of such materials, respectively. It is furthermore advantageous if the control element 1450 and the cushioning element 1410 are manufactured from materials from a common class of materials, as already mentioned above. Furthermore, the control element 1450 may comprise a number of openings 1452 of different sizes, a bulge 1455 in the medial region of the midfoot as well as a number of elevations 1458 and protrusions 1459. These elements serve, as already discussed, to influence the flexibility and stiffness properties of the control element 1450, which, for their part, influence the shear capacity and the bending stiffness of the sole and particularly the midsole 1410. The protrusions 1459 and the elevations 1458 can, furthermore, increase the ground grip, in particular, since the control element 1450 may be provided as a part of an outsole.

The embodiments shown in FIGS. 14*a*-14*c*, with a bulge 1455 in the medial region of the midfoot as well as a number of openings 1452 of varying diameter, enables a particularly good shear capacity in the heel region, especially in the lateral heel region, as well as a good stability in the medial midfoot region. As already mentioned several times, this combination of properties may be advantageous for use in case of running shoes. Other combinations of properties are, however, also possible, and the design options and embodiments presented herein enable the skilled person to manufacture a shoe having the desired properties.

Figure 15A:
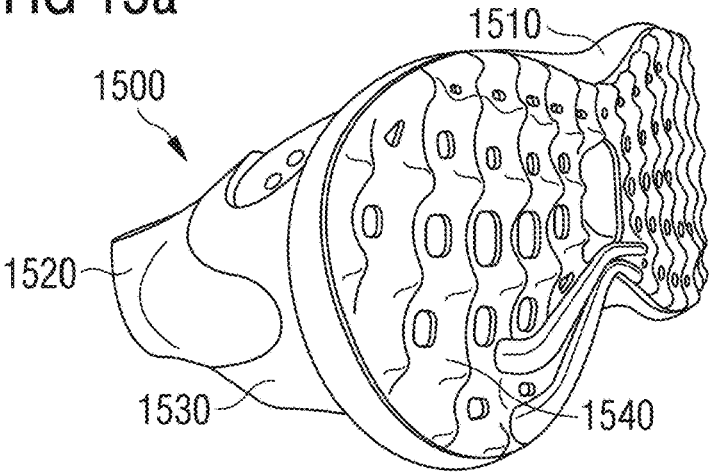
FIGS. 15*a*-*c* are perspective views of a shoe with a sole, according to certain embodiments of the present invention.
Figure 15B:
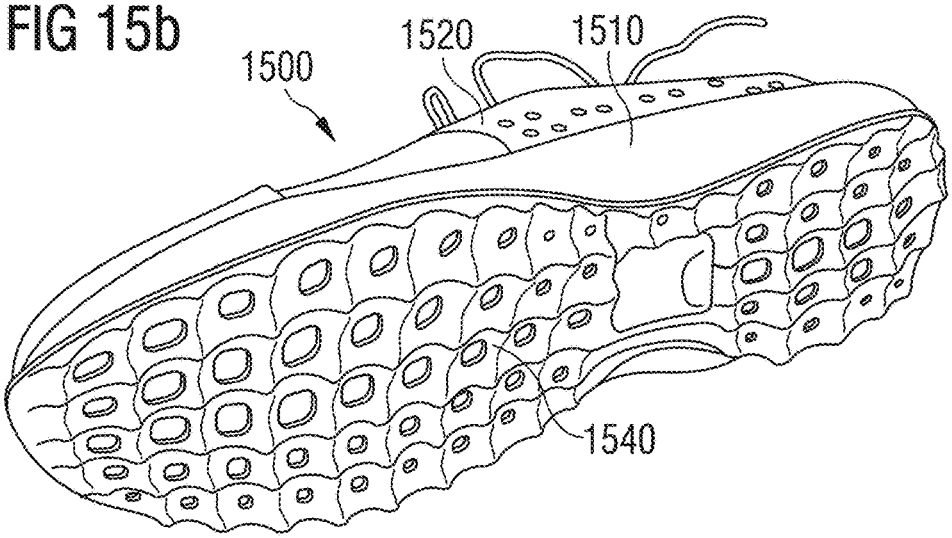
Figure 15C:
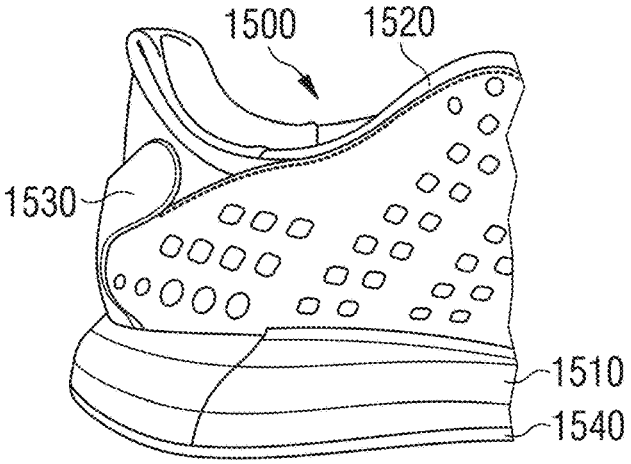

FIGS. 15*a*-15*c* show further embodiments of a shoe 1500 according to certain aspects of the present invention. The shoe 1500 comprises a cushioning element 1510 provided as a part of a midsole or as a midsole which comprises randomly arranged particles of expanded material, for example eTPU. Furthermore, the shoe 1500 comprises a control element 1540 provided as a part of an outsole or as an outsole which may selectively influence the shear capacity and the bending stiffness of the cushioning element 1510 in the way which was already repeatedly discussed. The shoe further comprises an upper 1520, as well as a heel clip 1530.

Figure 21A:
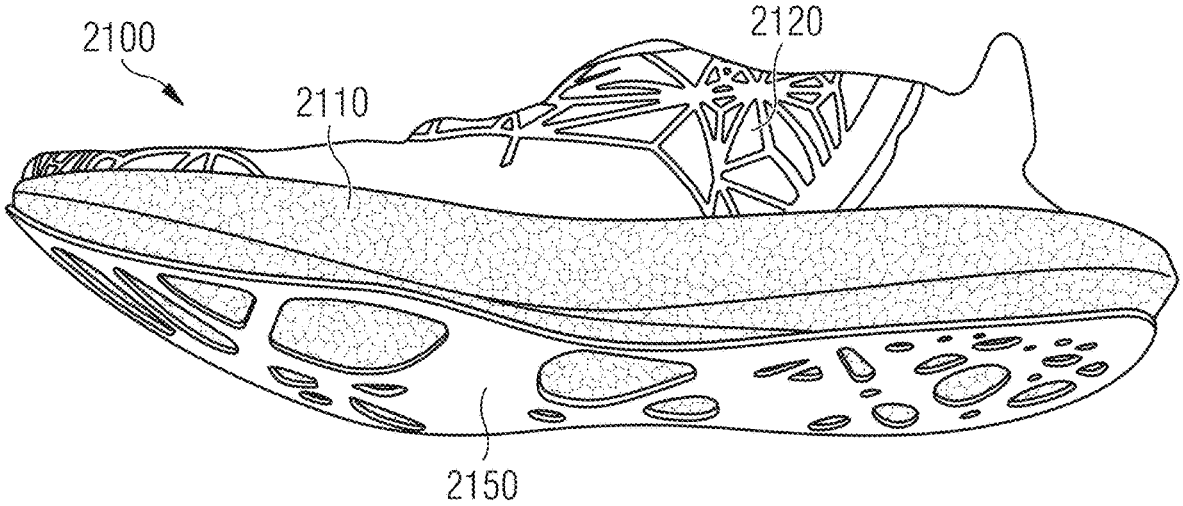
FIGS. 21*a*-*b* are perspective views of a shoe with a sole comprising a control element laser-cut from a blank, according to certain embodiments of the present invention.
Figure 21B:
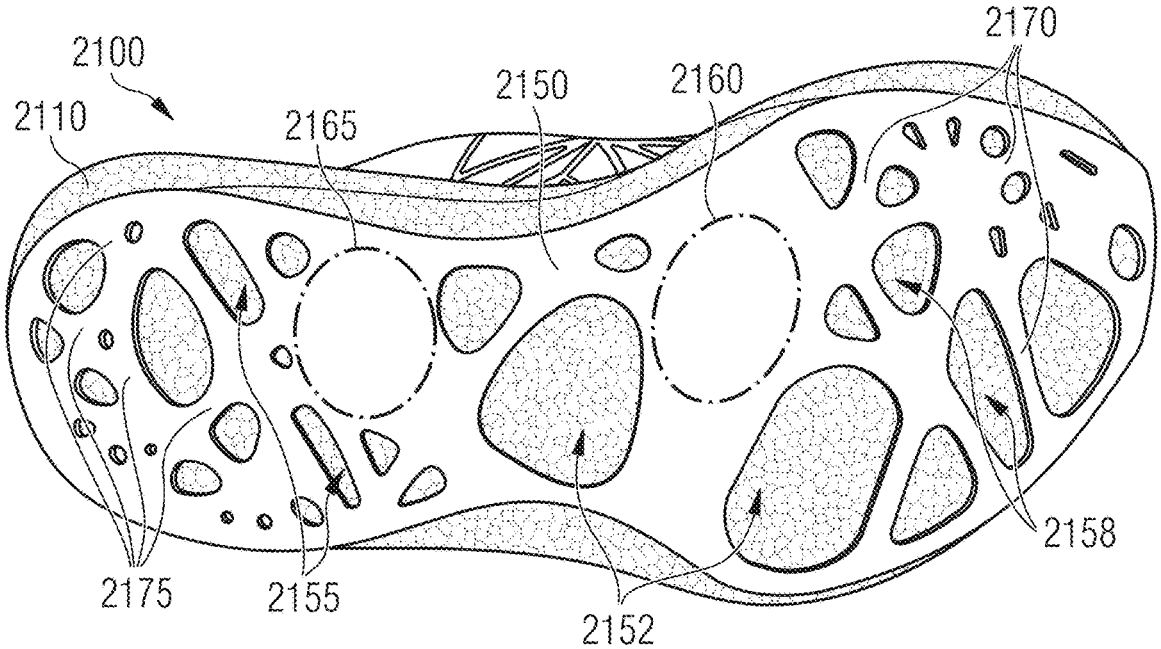

FIGS. 21*a*-*b* show other embodiments of a shoe 2100 according to the invention. The shoe 2100 comprises a sole comprising a cushioning element 2110 with randomly arranged particles of an expanded material. In the exemplary embodiments shown here, the cushioning element 2110 is provided as a midsole 2110. It may, however, also be merely a part thereof, for example.

The shoe 2100 furthermore comprises an upper 2120. The upper 2120 may be made from a large variety of materials and by a large variety of manufacturing methods. The upper 2120 may, in particular, be warp-knitted, weft-knitted, woven or braided, and it may comprise natural or synthetic materials, it may comprise fibers or yarns, multilaminate materials, compound materials and so on.

The sole of the shoe 2100 furthermore comprises a control element 2150, provided in the case at hand as an outsole 2150. In other cases it may only be part of an outsole or it may be part of the midsole. The control element 2150 is free from expanded material. Suitable materials for the control element/outsole 2150 may include rubber, non-expanded thermoplastic urethane, textile materials, PEBA, as well as foils and foil-like materials.

The control element 2150 reduces shearing motions within a first region of the cushioning element 2110 compared to shearing motions within a second region of the cushioning element 2110. Reduced shearing may, for example, occur in regions 2160, 2165 where the control element 2150 comprises continuous regions of material. It may also occur in the regions of the "material webs" 2170, 2175, which are interspersed by holes 2152, 2155, 2158 in the control element 2150. In the regions of these holes 2152, 2155, 2158, for example, the shearing motion may be increased in comparison.

Taking account of the explanations regarding the inventive concept of controlling the shearing motion of a cushioning element as described in this document, it is clear to a skilled person that by choosing different designs and arrangements of the continuous material regions (like regions 2160, 2165), the "material webs" (like web 2170) and the holes (like holes 2152, 2155, 2158), the shearing and other properties, like e.g. the bending stiffness, torsional stiffness or the general roll-off behavior, of the midsole 2110 of the shoe 2100 may be influenced as desired in a large number of ways. The influence may be fine-tuned even further with the potential inclusion of bulges, elevations, protrusions in the control element 2150, as already described before.

In the present case, the control element 2150 may be laser-cut from a blank (not shown). This may be done before the control element 2150 is affixed to the remaining parts of the sole of the shoe 2100, in particular the midsole 2110, and may be done in an automated manner, at least to a large degree. In principle, however, the blank may also be arranged at, e.g., the midsole 2110 first, then the blank is cut and finally the cut-out sections of the blank are removed. To this end, a bonding agent may be applied between the midsole 2110 and the blank, which does not immediately harden completely but still provides enough adhesion that the blank is secured on the midsole 2110 (or other parts of the shoe 2100) for it to be cut. For cutting, the shoe 2100 including the blank may e.g. be arranged on a last (i.e. shoe mold) to allow three-dimensional positioning within a cutting device. After removal of the cut-out pieces of the blank, which is still possible since the agent has not completely hardened, the bonding agent may then be left to harden completely or this may be facilitated by heating, cooling, energizing or other means.

In the simplest form, the blank may be provided as a material layer comprising, for example, one or more of the materials suitable for the manufacture of a control element/outsole mentioned above. It is also possible, for example, that the blanks are provided in different sizes, thickness, with predefined holes, bulges, elevations, protrusions and so forth, which may already provide a basic pattern that may then be fine-tuned by the laser-cutting process. Such a basic pattern may, e.g., be adapted to specific movement patterns occurring during, say, a specific sporting activity and different blanks may be used for the manufacture of shoes 2100 for the different sporting activities. Examples may include blanks for running shoes, tennis shoes, basketball shoes, football shoes, etc. This approach may have the advantage that the blanks may be produced quickly and in a large number beforehand and the individual customization may then be carried out more efficiently and more quickly. To this end, the blanks may also already comprise the general outline of a foot or sole.

This can, in particular, become important, if the customization, particularly by laser-cutting, is done on the spot, for example in a sales room, a sales stand at a sporting event or he like, where the is only limited room for a cutting device and manufacturing apparatus.

Laser-cutting the control element 2150 may provide for a large freedom in design for the control element 2150. It may also provide for the opportunity of an individual customization of the control element 2150, sole and shoe 2100, as already mentioned. It may, for example, allow for numerous fashion designs and a corresponding individualization of each sole or shoe 2100. The customization may be sport specific or according to typical movements of a customer or otherwise customer related. Furthermore, the laser-cutting may be automated to a large degree and may be based on, e.g., online tools or other ordering methods.

While reference has been made to laser cutting throughout the description of FIGS. 21*a-b*, other techniques are in principle also possible. Examples are CNC cutting, die cutting, water jet cutting.

Finally, FIGS. 22*a-d* show further embodiments of shoes 2200*a*, 2200*b*, 2200*c*, and 2200*d* according to the invention.

The main purpose of FIGS. 22*a-d* is to give the skilled person a better understanding of the scope and further possible embodiments of the present invention. Therefore, the embodiments 2200*a*, 2200*b*, 2200*c*, and 2200*d* will only be discussed briefly. For a more detailed discussion of individual aspects, reference is made to the discussion of the embodiments of shoes, soles, midsoles, cushioning elements and control elements according to the invention already put forth herein, in particular the discussion of the embodiments 100, 1400, 1500, 1600, 1700, 1800*a-d*, 1900, 2000 and 2100. The features, options and functionality discussed in relation to these embodiments also apply to the embodiments 2200*a*, 2200*b*, 2200*c*, and 2200*d*, as far as applicable.

The shoes 2200*a*, 2200*b*, 2200*c*, 2200*d* each have a sole comprising a respective cushioning element 2210*a*, 2210*b*, 2210*c* and 2210*d* comprising randomly arranged particles of an expanded material. Whereas the cushioning elements 2210*a* and 2210*b* of the shoes 2200*a* and 2200*b* only extend throughout the forefoot regions, the cushioning elements 2210*c* and 2210*d* of the shoes 2200*c* and 2200*d* extend throughout the entire soles of the shoes 2200*c*, 2200*d*. The cushioning elements 2210*a*, 2210*b*, 2210*c* and 2210*d* shown here are provided as part of a respective midsole. Other arrangements of the cushioning elements are, however, also conceivable.

The soles of the shoes 2200*a*, 2200*b*, 2200*c* and 2200*d* furthermore each comprise a control element 2250*a*, 2250*b*, 2250*c* and 2250*d* free from expanded material. The control elements 2250*a*, 2250*b*, 2250*c* and 2250*d* each reduce shearing motions within a first region of the respective cushioning element 2210*a*, 2210*b*, 2210*c* and 2210*d* compared to shearing motions within a second region of the respective cushioning element 2210*a*, 2210*b*, 2210*c* and 2210*d*. In the embodiments 2200*a*, 2200*b*, 2200*c* and 2200*d* shown here, the control elements 2250*a*, 2250*b*, 2250*c* and 2250*d* are provided as part of a respective outsole.

The control elements 2250*a*, 2250*b*, 2250*c* and 2250*d* may further serve the purpose to selectively increase the bending resistance of the respective cushioning element 2210*a*, 2210*b*, 2210*c* and 2210*d*.

To influence the shearing motions and bending stiffness of the respective cushioning elements 2210*a*, 2210*b*, 2210*c*, 2210*d* or soles, the control elements 2250*a*, 2250*b*, 2250*c* and 2250*d* comprise a number of holes or openings 2252*a*, 2252*b*, 2252*c*, 2252*d* in different arrangements, shapes, sizes, sole regions, etc. The control elements 2250*a*, 2250*b*, 2250*c* and 2250*d* further comprise a "web" or material mesh 2258*a*, 2258*b*, 2258*c*, 2258*d* between the individual openings 2252*a*, 2252*b*, 2252*c*, 2252*d*.

Figure 22A:
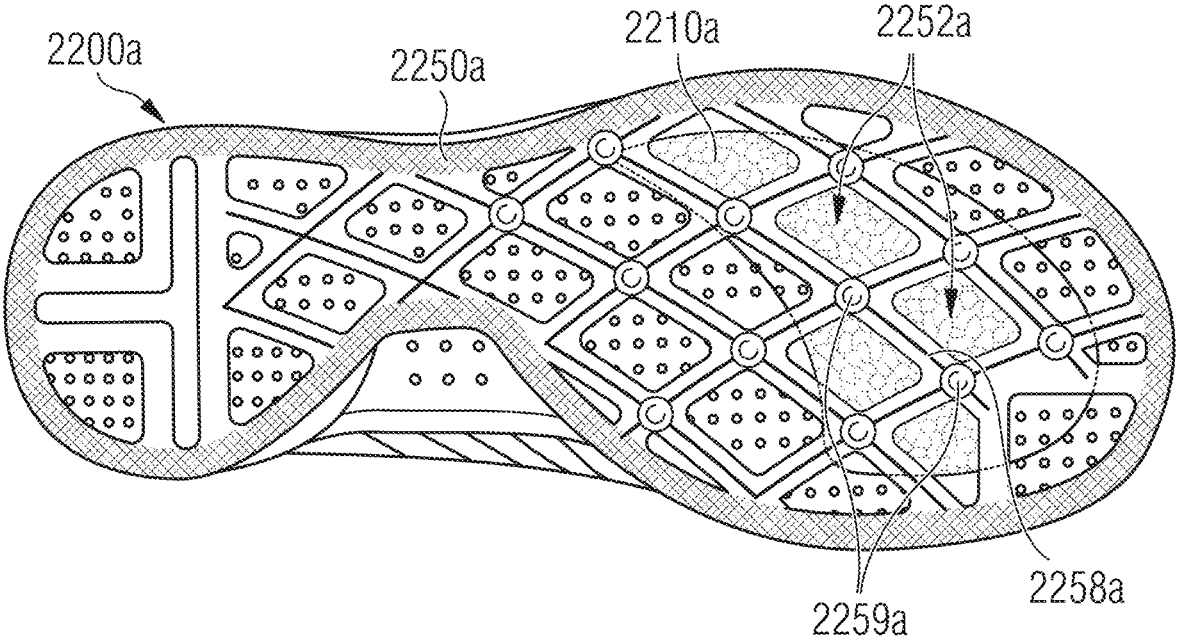
FIGS. 22*a*-*d* are bottom views of shoes with soles, according to certain embodiments of the present invention.
Figure 22B:
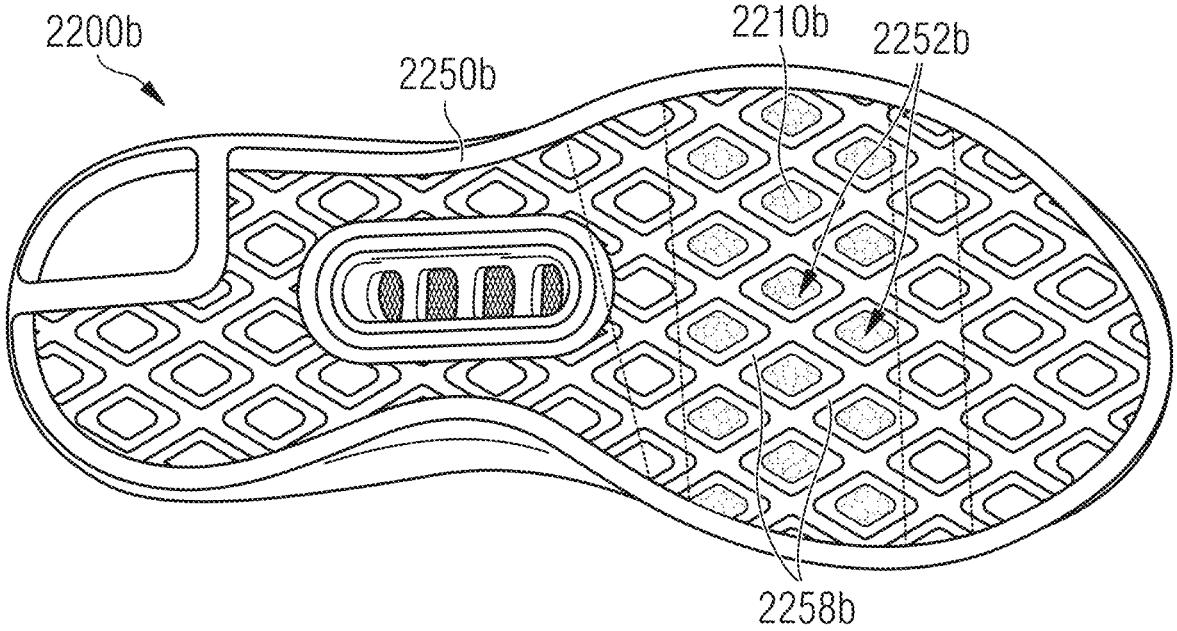
Figure 22C:
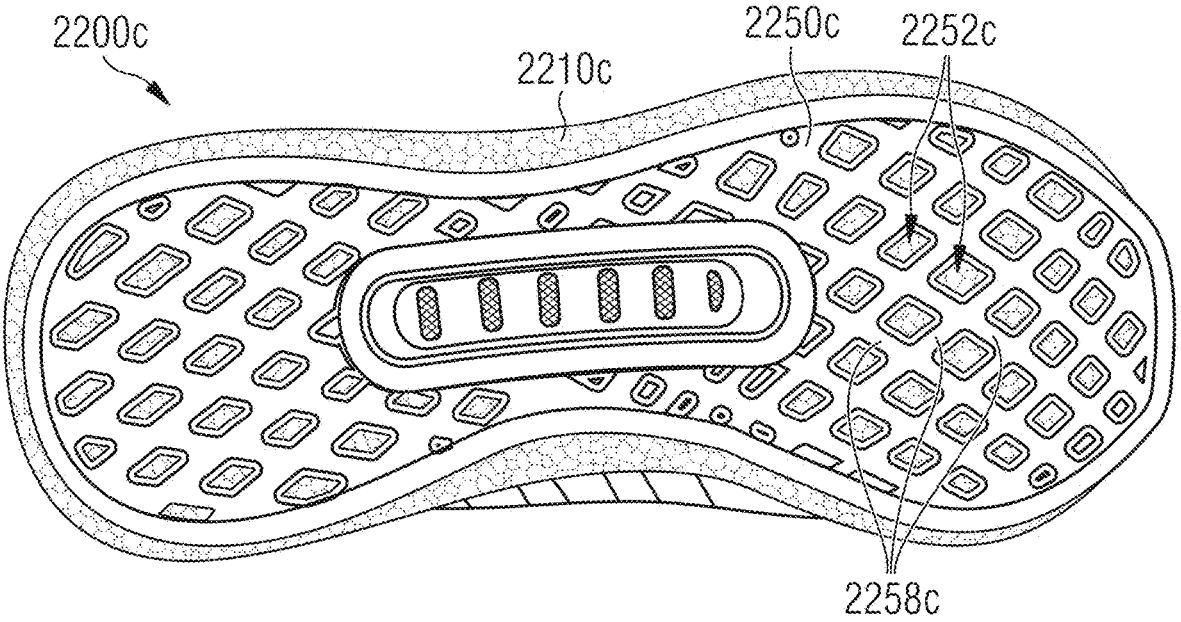
Figure 22D:
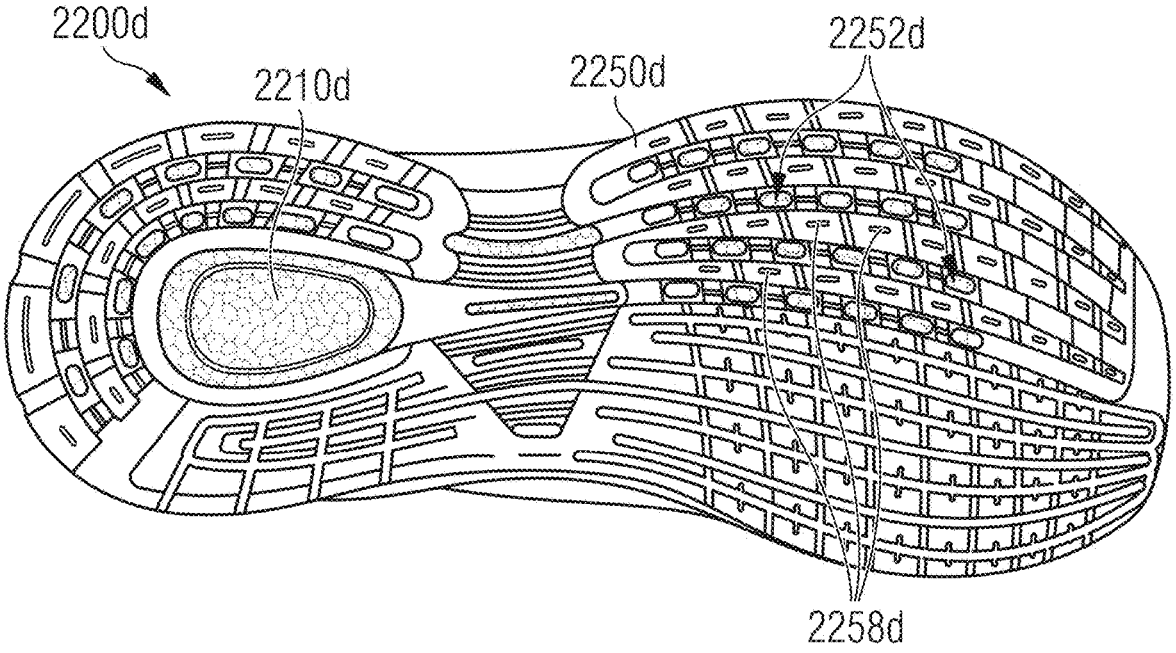

Whereas the openings 2252*a*, 2252*b*, 2252*c* and material meshes 2258*a*, 2258*b*, 2258*c* are configured in a diamond shape in the embodiments 2200*a*, 2200*b* and 2200*c*, the openings 2252*d* and material mesh 2258*d* roughly form parallelograms. Other configurations are, however, also possible, as already discussed at various times throughout this document and as shown, e.g., in the heel region of the shoe 2200*d*. Moreover, the control elements 2250*a*, 2250*b*, 2250*c* and 2250*d* may also comprise further protrusions, elevations, etc. For example, as shown in FIG. 22*a*, the control element 2250*a* comprises a number of protrusions 2259*a*.

The recurring arrangement of the openings 2252*a*, 2252*b*, 2252*c*, 2252*d* and material meshes 2258*a*, 2258*b*, 2258*c*, 2258*d* in diamond or parallelogram shape may in particular result in one or more preferred directions along which the soles may predominantly shear or bend. By the exact patterns and arrangement of the holes and material regions, these preferred directions may be adjusted to a given requirement profile for a particular sole or shoe.

In the following, further examples are described to facilitate the understanding of the invention:

1. Sole for a shoe, in particular a sports shoe, comprising:
   a. a cushioning element comprising randomly arranged particles of an expanded material,
   b. a control element free from expanded material,
   c. wherein the control element reduces shearing motions within a first region of the cushioning element compared to shearing motions within a second region of the cushioning element.
2. Sole according to example 1, wherein the particles of expanded material comprise one or more of the following materials: expanded ethylene-vinyl-acetate, expanded thermoplastic urethane, expanded polypropylene, expanded polyamide, expanded polyether block amide, expanded polyoxymethylene, expanded polystyrene, expanded polyethylene, expanded polyoxyethylene, expanded ethylene propylene diene monomer.
3. Sole according to one of the preceding examples 1-2, wherein the control element comprises one or more of the following materials: rubber, thermoplastic urethane, textile materials, polyether block amide, foils or foil-like materials.

4. Sole according to one of the preceding examples 1-3, wherein the first region of the cushioning element has a larger intrinsic shear resistance than the second region of the cushioning element.
5. Sole according to one of the preceding examples 1-4, wherein the control element has a larger thickness and/or fewer holes in a first control region controlling the shearing motion of the cushioning element in the first region than in a second control region controlling the shearing motion of the cushioning element in the second region.
6. Sole according to one of the preceding examples 1-5, wherein the cushioning element is provided as a part of a midsole.
7. Sole according to example 6, wherein the control element is provided as a part of an outsole.
8. Sole according to example 7, wherein the outsole comprises a decoupling region that is not directly attached to the second region of the cushioning element of the midsole.
9. Sole according to one of the preceding examples 1-8, wherein the control element and the cushioning element are manufactured from a common class of materials, in particular thermoplastic urethane.
10. Sole according to one of the preceding examples 1-9, wherein the first region is located in the medial midfoot region and wherein the second region is located in the lateral heel region.
11. Sole according to one of the preceding examples 1-10, wherein the control element further increases the bending resistance of the cushioning element in the first region compared to the second region.
12. Sole according to one of the preceding examples 1-11, further comprising a frame made from non-expanded material, in particular ethylene-vinyl-acetate, surrounding at least a part of the cushioning element.
13. Sole according to one of the preceding examples 1-12, wherein the cushioning element allows for a shearing motion in longitudinal direction of a lower sole surface relative to an upper sole surface of more than 1 mm, preferably more than 1.5 mm, and particularly preferably more than 2 mm.
14. Sole according to one of the preceding examples 1-13, wherein the control element is laser-cut from a blank.
15. Shoe, in particular a sports shoe, with a sole according to one of the preceding examples 1-14.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A method for forming a sole for a shoe, the method comprising:

a. cutting a customized control element from a blank, wherein the cutting comprises laser cutting, die cutting, water jet cutting or computer numerical control (CNC) cutting, wherein the customized control element is free from expanded material;

b. integrally-forming a cushioning element comprising an expanded material in the form of randomly arranged expanded particles which have substantially retained their individual particle shapes in the integrally-formed piece, the cushioning element comprising a first region and a second region; and c. affixing the customized control element to a cushioning element;

d. wherein the customized control element comprises a first control region proximate to the first region and a second control region proximate to the second region;

e. wherein the first control region has at least one of the following features as compared to the second control region: (i) protrusions that are greater in size as compared to protrusions in the second control region, different hardness than in the second control region, and/or different expansion than in the second control region, or (ii) bulges that are greater in length, thickness, and/or structure as compared to bulges in the second control region, and f. wherein, under shear, the first control region engages with the first region of the cushioning element by selectively increasing the penetration of the at least one feature into the cushioning element positioned proximate the at least one feature, wherein the increased penetration reduces shearing motions within the first region to a greater extent than the second control region reduces shearing motions within the second region.

2. The method according to claim 1, wherein the particles of expanded material comprise one or more of the following materials: expanded ethylene-vinyl-acetate, expanded polypropylene, expanded polyamide, expanded polyether block amide, expanded polyoxymethylene, expanded polystyrene, expanded polyethylene, expanded polyoxyethylene, and expanded ethylene propylene diene monomer.

3. The method according to claim 1, wherein the control element comprises one or more of the following materials: rubber, thermoplastic urethane, textile materials, polyether block amide, foils or foil-like materials.

4. The method according to claim 1, wherein the control element has a larger thickness in a first control region controlling a shearing motion of the cushioning element in the first region than in a second control region controlling a shearing motion of the cushioning element in the second region.

5. The method according to claim 1, wherein the control element has fewer holes in a first control region controlling a shearing motion of the cushioning element in the first region than in a second control region controlling a shearing motion of the cushioning element in the second region.

6. The method according to claim 1, wherein the cushioning element is provided as a part of a midsole.

7. The method according to claim 5, wherein the control element is provided as a part of an outsole.

8. The method according to claim 7, wherein the outsole comprises a decoupling region that is not directly attached to the second region of the cushioning element of the midsole.

9. The method according to claim 8, wherein the control element and the cushioning element are manufactured from thermoplastic urethane.

10. The method according to claim 1, wherein the first region is located in a medial midfoot region and wherein the second region is located in a lateral heel region.

11. The method according to claim 1, wherein the control element further increases a bending resistance of the cushioning element in the first region compared to the second region.

12. The method according to claim 1, wherein the cushioning element allows for a shearing motion in longitudinal direction of a lower sole surface relative to an upper sole surface of more than 1 mm.

13. The method according to claim 1, wherein the cutting comprises laser cutting.

14. The method according to claim 1, wherein the cutting comprises die cutting.

15. The method according to claim 1, wherein the cutting comprises water jet cutting.

16. The method according to claim 1, wherein the cutting comprises CNC cutting.

17. A method for forming a sole for a shoe, the method comprising:

a. cutting a customized control element from a blank, wherein the cutting comprises laser cutting, die cutting, water jet cutting or computer numerical control (CNC) cutting, wherein the customized control element is free from expanded material;

b. integrally-forming a cushioning element comprising an expanded material in the form of randomly arranged expanded particles which have substantially retained their individual particle shapes in the integrally-formed piece, the cushioning element comprising a first region and a second region; and c. bonding the customized control element to a cushioning element.

18. The method according to claim 17, wherein the bonding is conducted by applying a bonding agent between the cushioning element and the customized control element prior to the cutting, wherein the bonding agent is not completely hardened prior to the cutting.

19. The method according to claim 18, wherein the method further comprises:

heating the bonding agent after the customizer control element is cut.

20. The method according to claim 18, wherein the method further comprises:

cooling the bonding agent after the customizer control element is cut.

* * * * *